US010224622B2

(12) United States Patent
Ying et al.

(10) Patent No.: US 10,224,622 B2
(45) **Date of Patent: *Mar. 5, 2019**

(54) ANTENNAS INCLUDING DUAL RADIATING ELEMENTS FOR WIRELESS ELECTRONIC DEVICES

(71) Applicants: Sony Corporation, Tokyo (JP); Sony Mobile Communications Inc., Tokyo (JP)

(72) Inventors: Zhinong Ying, Lund (SE); Kun Zhao, Stockholm (SE)

(73) Assignee: Sony Mobile Communications Inc., Tokyo (JP)

( * ) Notice: Subject to any disclaimer, the term of this patent is extended or adjusted under 35 U.S.C. 154(b) by 36 days.

This patent is subject to a terminal disclaimer.

(21) Appl. No.: 15/605,284

(22) Filed: May 25, 2017

(65) Prior Publication Data

US 2017/0264008 A1 Sep. 14, 2017

Related U.S. Application Data

(63) Continuation of application No. 14/681,432, filed on Apr. 8, 2015, now Pat. No. 9,692,112.

(51) Int. Cl.

| | |
|---|---|
| ***H01Q 1/00*** | (2006.01) |
| ***H01Q 1/38*** | (2006.01) |
| ***H01Q 1/52*** | (2006.01) |
| ***H01Q 9/04*** | (2006.01) |
| ***H01Q 21/00*** | (2006.01) |
| ***H01Q 21/08*** | (2006.01) |

(Continued)

(52) U.S. Cl.

CPC ..... *H01Q 1/38* (2013.01); *H01Q 1/523* (2013.01); *H01Q 5/10* (2015.01); *H01Q 9/0457* (2013.01); *H01Q 9/0485* (2013.01); *H01Q 21/0075* (2013.01); *H01Q 21/08* (2013.01); *H01Q 21/24* (2013.01)

(58) Field of Classification Search

CPC ..... H01Q 1/38; H01Q 21/0075; H01Q 5/10; H01Q 1/523; H01Q 21/08; H01Q 9/0457

USPC ..... 343/700 MS, 702, 864, 767, 904

See application file for complete search history.

(56) References Cited

U.S. PATENT DOCUMENTS 5,923,296 A 7/1999 Sanzgiri et al.
8,063,832 B1 11/2011 Weller et al.

(Continued)

OTHER PUBLICATIONS

International Preliminary Report on Patentability and the Written Opinion of the International Searching Authority corresponding to International Patent Application No. PCT/JP2015/005122 (11 pages) (dated Oct. 19, 2017).

(Continued)

*Primary Examiner* — Hai Tran
(74) *Attorney, Agent, or Firm* — Myers Bigel, P.A.

(57) ABSTRACT

A wireless electronic device includes first and second conductive layers arranged in a face-to-face relationship. The first and second conductive layers are separated from one another by a first dielectric layer. The wireless electronic device includes a first radiating element and a second radiating element. The first conductive layer includes a slot. The second conductive layer includes a stripline. The second radiating element at least partially overlaps the slot. The wireless electronic device is configured to resonate at a resonant frequency corresponding to the first radiating element and/or the second radiating element when excited by a signal transmitted and/or received though the stripline.

19 Claims, 22 Drawing Sheets

(51) Int. Cl.
*H01Q 21/24* (2006.01)
*H01Q 5/10* (2015.01)

(56) References Cited

U.S. PATENT DOCUMENTS

| | | | |
|---|---|---|---|
| 2004/0239565 | A1 | 12/2004 | Brachat |
| 2007/0210962 | A1 | 9/2007 | Yang |
| 2012/0218167 | A1 | 8/2012 | He et al. |
| 2014/0253400 | A1 | 9/2014 | Tiezzi et al. |

OTHER PUBLICATIONS

International Search Report and Written Opinion Corresponding to International Application No. PCT/JP2015/005122; dated Jan. 15, 2016; 16 Pages.

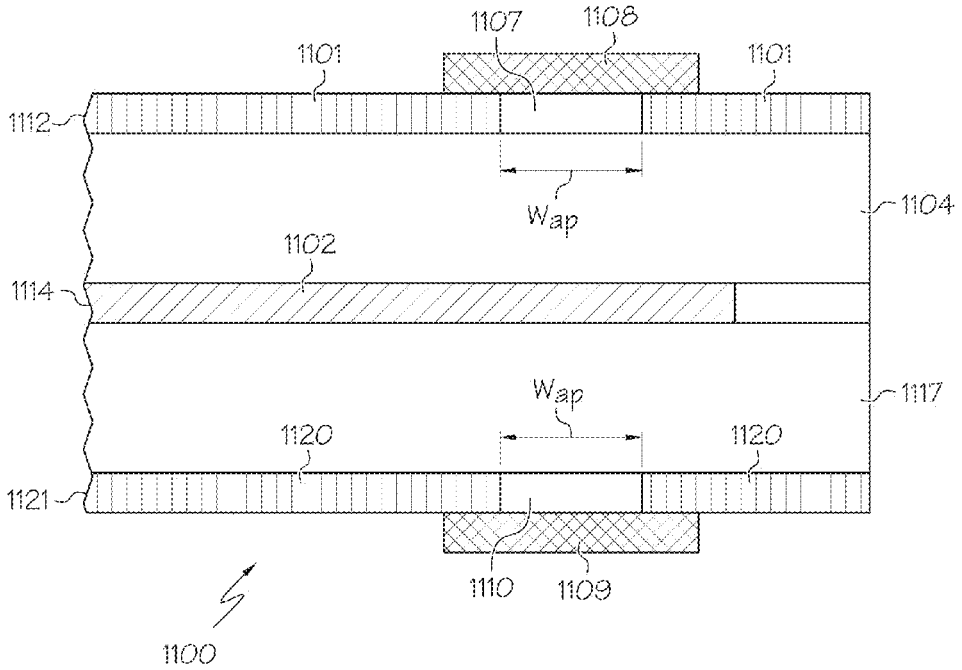
FIG. 11A
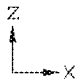

ANTENNAS INCLUDING DUAL RADIATING ELEMENTS FOR WIRELESS ELECTRONIC DEVICES

CROSS REFERENCE TO RELATED APPLICATION

The present application is a continuation of U.S. patent application Ser. No. 14/681,432, filed Apr. 8, 2015, the disclosure of which is hereby incorporated herein by reference in its entirety.

TECHNICAL FIELD

The present inventive concepts generally relate to the field of wireless communications and, more specifically, to antennas for wireless communication devices.

BACKGROUND

Wireless communication devices such as cell phones and other user equipment may include antennas that may be used to communicate with external devices. These antennas may produce broad radiation patterns. Some antenna designs, however, may facilitate irregular radiation patterns whose main beam is directional.

SUMMARY

Various embodiments of the present inventive concepts include a wireless electronic device including first and second conductive layers arranged in a face-to-face relationship. The first and second conductive layers may be separated from one another by first dielectric layer. The first conductive layer may include a slot, and the second conductive layer may include a stripline. The first radiating element may at least partially overlap the slot and/or the second radiating element may at least partially overlap the first radiating element. The wireless electronic device may be configured to resonate at a resonant frequency corresponding to the first radiating element and/or the second radiating element when excited by a signal transmitted and/or received though the stripline.

According to various embodiments, the first radiating element and the second radiating element may be configured such that a first polarization of the signal at the first radiating element may be orthogonal to a second polarization of the signal at the second radiating element. The width of the slot may control impedance matching to the wireless electronic device. The stripline may overlap the first radiating element, the second radiating element, and/or the slot in the first conductive layer.

In some embodiments, the wireless electronic device may include a power divider that is electrically connected and/or coupled to the stripline. The power divider may be configured to control power of the signal that is applied to the first radiating element and/or the second radiating element. The first radiating element and the second radiating element may be configured such that a first polarization of the signal at the first radiating element may be orthogonal to a second polarization of the signal at the second radiating element. The power divider may be configured to provide a first portion of the power of the signal to the first radiating element for a first time period, and a second portion of the power of the signal to the second radiating element for a second time period. In some embodiments, the power divider may be configured to provide all of the power of the signal to the first radiating element for the first time period, and provide all of the power of the signal to the second radiating element for the second time period. In some embodiments, the first time period may not overlap the second time period.

In some embodiments, the stripline may include a first stripline associated with the first radiating element. The wireless electronic device may further include a second stripline in the second conductive layer. The second stripline may be associated with the second radiating element. The power divider may provide the first portion of the power of the signal to the first stripline and may provide the second portion of the power of the signal to the second stripline.

According to various embodiments, the stripline may be a first stripline associated with the first radiating element. The wireless electronic device may include a second stripline associated with the second radiating element. The second stripline may be in a third conductive layer that is arranged in a face-to-face relationship with the first conductive layer and/or the second conductive layer. The power divider may provide a first portion of the power of the signal to the first stripline and a second portion of the power of the signal to the second stripline.

According to various embodiments, the stripline may be a first stripline. The wireless electronic device may include one or more third radiating elements and/or one or more fourth radiating elements. The first conductive layer may include one or more additional slots and the second conductive layer may include one or more striplines. Respective ones of the third radiating elements may partially overlap respective ones of the fourth radiating elements and/or respective ones of the one or more additional slots. In some embodiments, a respective one of the third radiating elements and the associated respective one of the fourth radiating elements may be configured such that a polarization of the signal at respective ones of the third radiating elements may be orthogonal to a polarization of the signal at the respective ones of the fourth radiating elements.

In various embodiments, the first stripline and the one or more additional striplines may be arranged in an array. The first stripline and the one or more additional striplines may be configured to receive and/or transmit multiple-input and multiple-output (MIMO) communication.

In various embodiments, the wireless electronic device may include a fourth conductive layer and/or a fifth conductive layer. The first radiating element may include a first patch element, and the second radiating element may include a second patch element. The first and fourth conductive layers may be arranged in a face-to-face relationship, separated from one another by a second dielectric layer. The second and fifth conductive layers may be arranged in a face-to-face relationship, separated from one another by a third dielectric layer that is opposite the first dielectric layer.

According to various embodiments of the present inventive concepts, the stripline may include a first stripline, and the slot may include a first slot. The wireless electronic device may include a third conductive layer including a second stripline, and/or a sixth conductive layer including a second slot. The second patch element may at least partially overlaps the second slot. The third conductive layer and the sixth conductive layer may be separated from one another by a fourth dielectric layer, that is opposite the third dielectric layer. The sixth conductive layer and the fifth conductive layer may be separated from one another by a sixth dielectric layer that is opposite the fourth dielectric layer. The wireless electronic device may include a seventh conductive layer including a ground plane. The seventh conductive layer may be between the third dielectric layer and a fifth dielectric layer that is adjacent the third conductive layer.

According to various embodiments, the stripline may include a first stripline. The wireless electronic may include one or more third patch elements in the fourth conductive layer, and/or one or more fourth patch elements in the fifth conductive layer. The first conductive layer may include one or more additional slots. The second conductive layer may include one or more additional striplines. Respective ones of the third patch elements may at least partially overlap respective ones of the fourth patch elements and/or respective ones of the one or more additional slots.

According to various embodiments of the present inventive concepts, the first radiating element may include a first dielectric block on the first conductive layer. The second radiating element may include a second dielectric block on a sixth conductive layer. In some embodiments, the stripline may include a first stripline, and the slot may include a first slot. The wireless electronic device may include a third conductive layer including a second stripline. The sixth conductive layer may include a second slot. In some embodiments, the second dielectric block may at least partially overlap the second slot. The second conductive layer and the third conductive layer may be separated from one another by a third dielectric layer. The third conductive layer and the sixth conductive layer may be separated from one another by a fourth dielectric layer, that is opposite the third dielectric layer. In some embodiments, the wireless electronic device may include a seventh conductive layer that includes a ground plane. The seventh conductive layer may be between the third dielectric layer and a fifth dielectric layer that is adjacent the third conductive layer.

The wireless electronic device may further include a metal ring antenna. The resonant frequency may include a first resonant frequency. The metal ring antenna may be configured to resonate at a second resonant frequency that is different from the first resonant frequency. The metal ring antenna may be spaced apart and electrically isolated from the first and/or second conductive layers. The metal ring antenna may extend along an outer edge of the wireless electronic device.

Various other embodiments of the present inventive concepts include a wireless electronic device including a printed circuit board (PCB). The PCB may include a first radiating element on a first conductive layer including a first slot. The first slot may be at least partially overlapped by the first radiating element. The PCB may include a second radiating element on a sixth conductive layer including a second slot. The second slot may be at least partially overlapped by the second radiating element. The second conductive layer may include a first stripline and the third conductive layer may include a second stripline. The PCB may include a seventh conductive layer including a ground plane. The PCB may include a first dielectric layer between the first conductive layer and the second conductive layer, and/or a third dielectric layer between the second conductive layer and the seventh conductive layer, opposite the first dielectric layer. The PCB may include a fifth dielectric layer between the seventh conductive layer and the third conductive layer, opposite the third dielectric layer. The PCB may include a fourth dielectric layer between the third conductive layer and the sixth conductive layer, opposite the fifth dielectric layer. In some embodiments, a metal ring antenna may extend along an outer edge of the PCB.

Other devices and/or operations according to embodiments of the inventive concepts will be or become apparent to one with skill in the art upon review of the following drawings and detailed description. It is intended that all such additional devices and/or operations be included within this description, be within the scope of the present inventive concepts, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the present disclosure and are incorporated in and constitute a part of this application, illustrate certain embodiment(s). In the drawings:

FIG. 11A and 11B illustrate dual DRA antennas, according to various embodiments of the present inventive concepts.

DETAILED DESCRIPTION

Figure 1A:
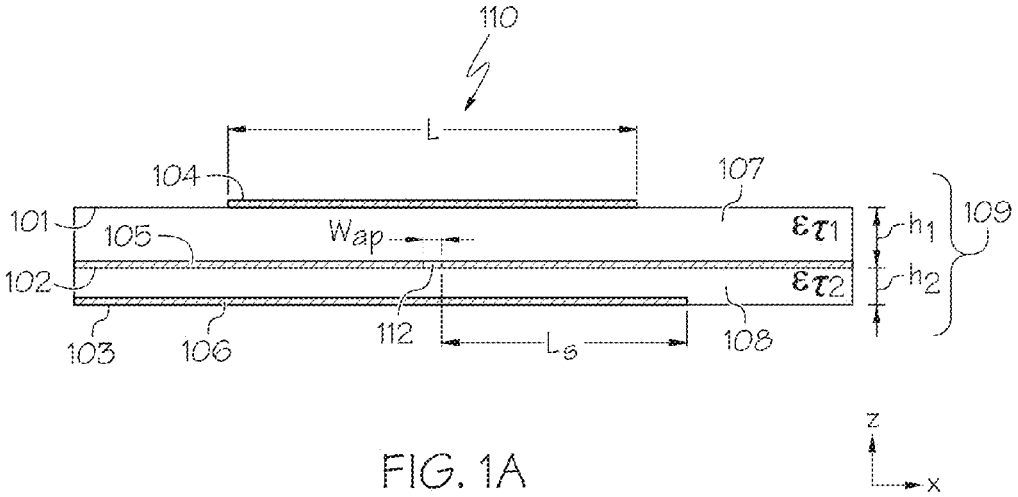
FIG. 1A illustrates a single patch antenna on a printed circuit board (PCB), according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

A patch antenna is commonly used in microwave antenna design for wireless electronic devices such as mobile terminals. A patch antenna may include a radiating element on a printed circuit board (PCB). As used herein, a PCB may include any conventional printed circuit board material that is used to mechanically support and electrically connect electronic components using conductive pathways, tracks or signal traces. The PCB may comprise laminate, copper-clad laminates, resin-impregnated B-stage cloth, copper foil, metal clad printed circuit boards and/or other conventional printed circuit boards. In some embodiments, the printed circuit board is used for surface mounting of electronic components thereon. The PCB may include one or more integrated circuit chip power supplies, integrated circuit chip controllers and/or other discrete and/or integrated circuit passive and/or active microelectronic components, such as surface mount components thereon. The PCB may comprise a multilayered printed wiring board, flexible circuit board, etc., with pads and/or metal traces that are on the surface of the board and/or on intervening layers of the PCB.

Patch antenna designs may be compact in size and easy to manufacture since they may be implemented as printed features on PCBs. A dielectric resonator antenna (DRA) is also commonly used in microwave antenna design for wireless electronic devices such as mobile terminals. The DRA may include a radiating element such as a flux couple on a PCB with a dielectric block on the flux couple.

Various wireless communication applications may use patch antennas and/or DRAs. Patch antennas and/or DRAs may be suitable for use in the millimeter band radio frequencies in the electromagnetic spectrum from 10 GHz to 300 GHz. Patch antennas and/or DRAs may each provide radiation beams that are quite broad. A potential disadvantage of patch antenna designs and/or DRA designs may be that the radiation pattern is directional. For example, if a patch antenna is used in a mobile device, the radiation pattern may only cover half the three dimensional space around the mobile device. In this case, the antenna produces a radiation pattern that is directional, and may require the mobile device to be directed towards the base station for adequate operation.

Various embodiments described herein may arise from the recognition that the patch antenna and/or the DRA may be improved by adding another radiating element on or near the opposite side of the printed circuit board, producing a dual patch antenna and/or a dual DRA design. The dual radiating elements may improve the antenna performance by producing a radiation pattern that covers the three-dimensional space around the mobile device.

Referring now to FIG. 1A, the diagram illustrates a single patch antenna 110 on a printed circuit board (PCB) 109. The PCB 109 includes a first conductive layer 101, a second conductive layer 102, and a third conductive layer 103. The first, second, and/or third conductive layers (101, 102, 103) may be arranged in a face-to-face relationship. The first, second, and third conductive layers (101, 102, 103) are separated from one another by a first dielectric layer 107 and/or a second dielectric layer 108, respectively. A first radiating element 104 may be in the first conductive layer 101. A stripline 106 may be in the third conductive layer of the single patch antenna 110. A ground plane 105 may be in the second conductive layer 102. The ground plane 105 may include an opening or slot 112. The width of the slot 112 may be $W_{ap}$. A signal may be received and/or transmitted through the stripline 106, causing the single patch antenna 110 to resonate.

Figure 1B:
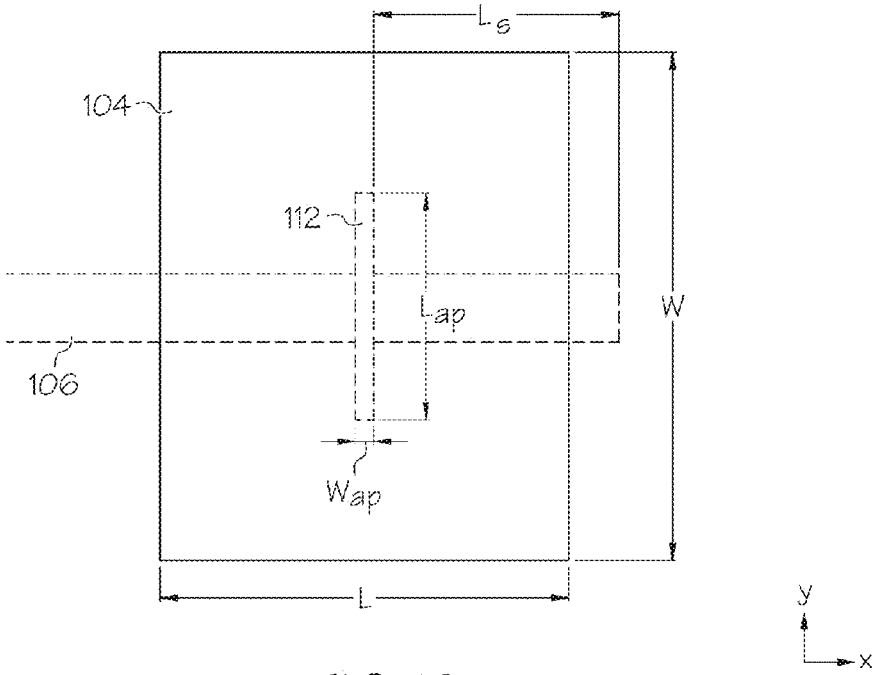
FIG. 1B illustrates a plan view of the single patch antenna of FIG. 1A, according to various embodiments of the present inventive concepts.

Referring now to FIG. 1B, a plan view of the single patch antenna 110 of FIG. 1A is illustrated. The first radiating element 104 may have a length L and width W. The first radiating element 104 may overlap the stripline 106. The stripline may overlap a slot 112 in the ground plane of the single patch antenna 110. The slot 112 in the ground plane of the single patch antenna 110 may have width $W_{ap}$ and/or length $L_{ap}$. In some embodiments, the stripline 106 may extend beyond the first radiating element 104, for a length $L_a$ from the slot 112.

Electromagnetic properties of the described antenna structures may be determined by physical dimensions and/or other parameters. For example, parameters such as stripline width, stripline positioning, dielectric layer thickness, dielectric layer permittivity, dimensions $W_{ap}$ and/or length $L_{ap}$ of the slot in the ground plane, and/or dimensions L and/or W of the first radiating element 104 may affect the electromagnetic properties of antenna structures and subsequently the antenna performance. In some embodiments, the relative permittivity of the first dielectric layer 107 may be $\varepsilon\tau_1$ while the relative permittivity of the second dielectric layer may be $\varepsilon\tau_2$. $\varepsilon\tau_2$ may be different from $\varepsilon\tau_1$.

Figure 1C:
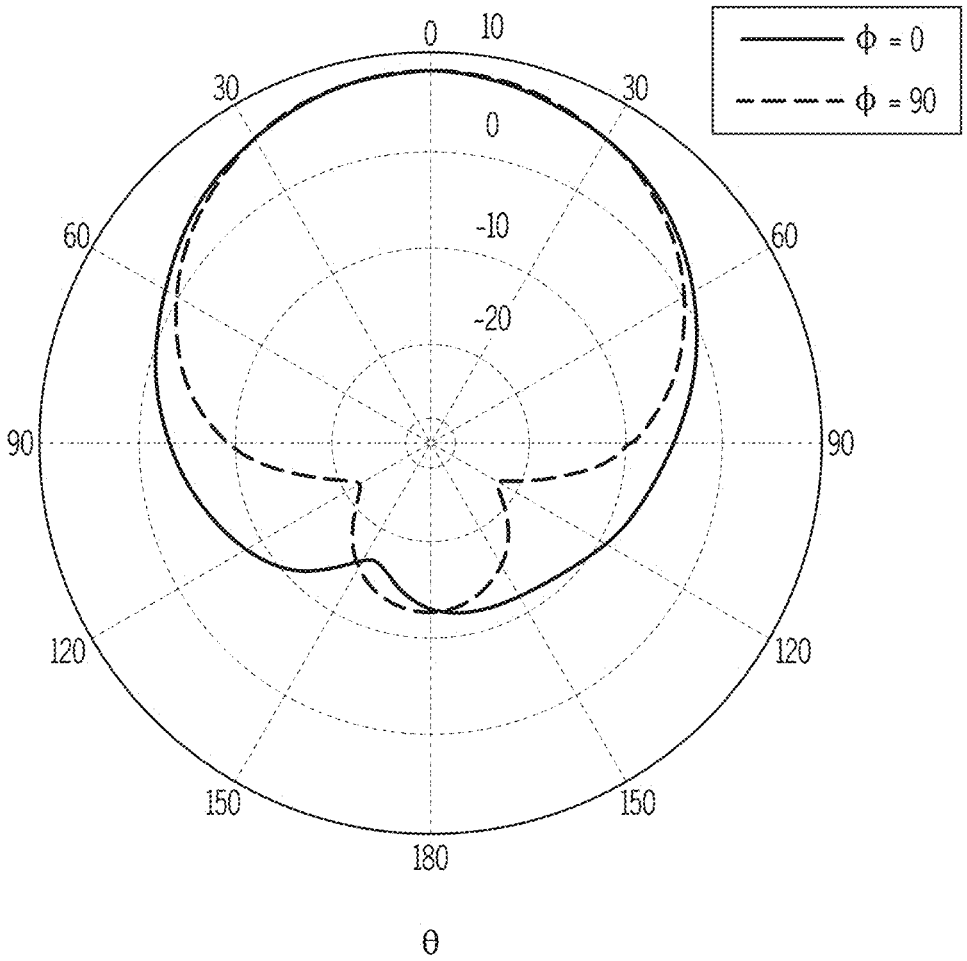
FIG. 1C illustrates radiation patterns at two different phases for the single patch antenna of FIGS. 1A and 1B, according to various embodiments of the present inventive concepts.

Referring now to FIG. 1C, radiation patterns for two different phases of the single patch antenna 110 of FIGS. 1A and 1B are illustrated. The radiation patterns at phase $\phi=0°$ and phase $\phi=90°$ are illustrated. Both radiation patterns appear to be broad and symmetric. However, the radiation patterns are directional, mostly covering one half the space around the antenna. In other words, if the single patch antenna 110 is placed in a mobile device, one side of the mobile device would have excellent performance while the opposite side of the mobile device would have poor performance. This directional behavior of the single patch antenna may provide good performance in certain orientations with respect to a base station and/or poor performance in other orientations with respect to the base station.

Figure 2:
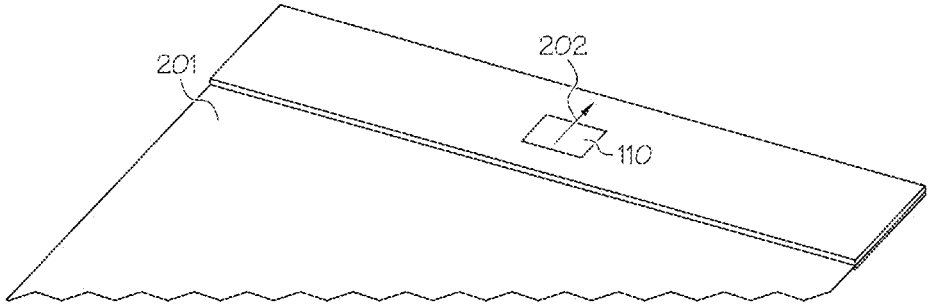
FIG. 2 illustrates the single patch antenna of FIGS. 1A and 1B in a wireless electronic device, according to various embodiments of the present inventive concepts.

Referring now to FIG. 2, a wireless electronic device 201 that includes the single patch antenna 110 of FIGS. 1A and 1B is illustrated. The single patch antenna 110 is positioned along an edge of the wireless electronic device 201. Other components may be included in the wireless electronic device 201, but are not illustrated for purposes of simplicity. The polarization of the single patch antenna 110 may be in the direction indicated by arrow 202 in FIG. 2, such as, for example, towards the top of the wireless electronic device 201.

Figure 3A:
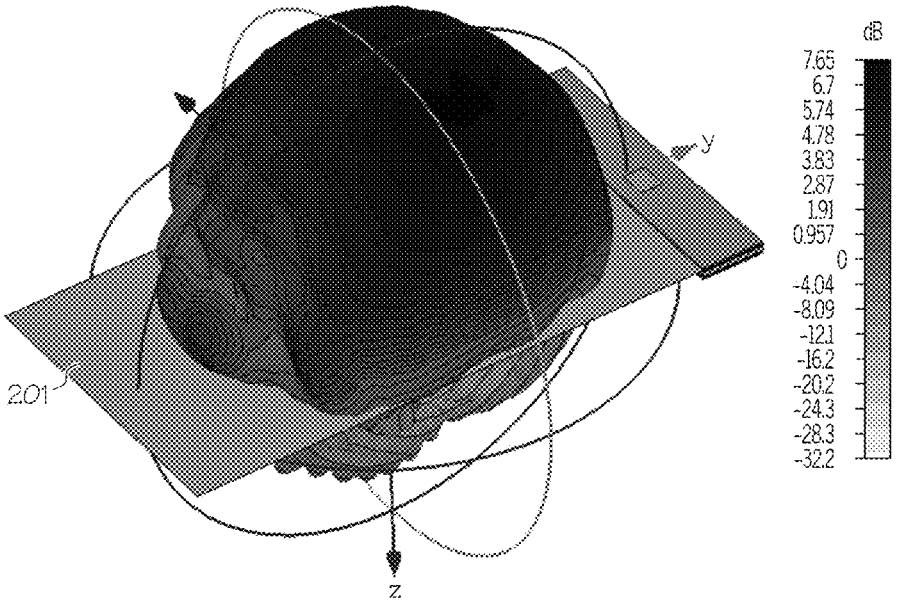
FIG. 3A illustrates the radiation pattern around a wireless electronic device such as a smartphone, including the single patch antenna of FIG. 2, according to various embodiments of the present inventive concepts.

Referring now to FIG. 3A, the radiation pattern around a wireless electronic device 201 including the single patch antenna 110 of FIGS. 1A and 1B is illustrated. When the single patch antenna 110 is excited at 15.1 GHz, an irregular radiation pattern is formed around the wireless electronic device 201. The radiation pattern around the wireless electronic device 201 exhibits directional distortion with broad, even radiation covering one half the space around the antenna but poor radiation around the other half of the antenna. Hence, this antenna may not be suitable for communication at this frequency since some orientations exhibit poor performance.

Figure 3B:
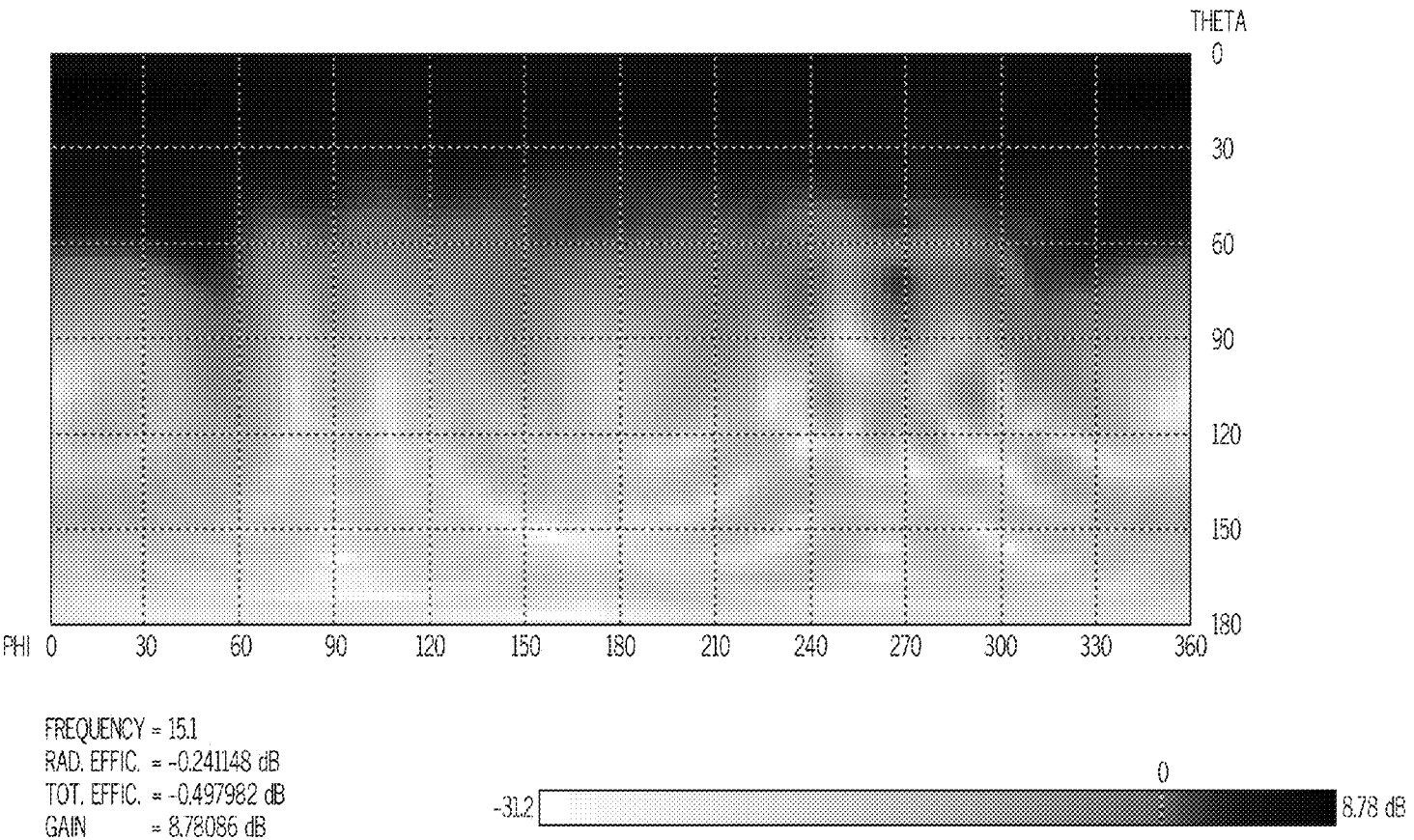
FIG. 3B illustrates the absolute far field gain, at 15.1 GHz excitation, along a wireless electronic device including the single patch antenna of FIG. 2, according to various embodiments of the present inventive concepts.

Referring now to FIG. 3B, the absolute far field gain, at 15.1 GHz excitation, along a wireless electronic device 201 including the single patch antenna 110 of FIG. 2 is illustrated. The axis Theta represents the y-z plane while the axis Phi represents the x-y plane around the wireless electronic device 201of FIG. 2. Similar to the resulting radiation pattern of FIG. 3A, the absolute far field gain exhibits satisfactory gain characteristics in one direction around the wireless electronic device 201, such as, for example, spanning broadly in the x-y plane. However, in the y-z plane, good absolute far field gain results are obtained in one direction, for example, 90° to 180° around the wireless electronic device 201, but poor absolute far field gain results are obtained in the opposite direction in the y-z plane, for example, 0° to 90° around the wireless electronic device 201.

Figure 4A:
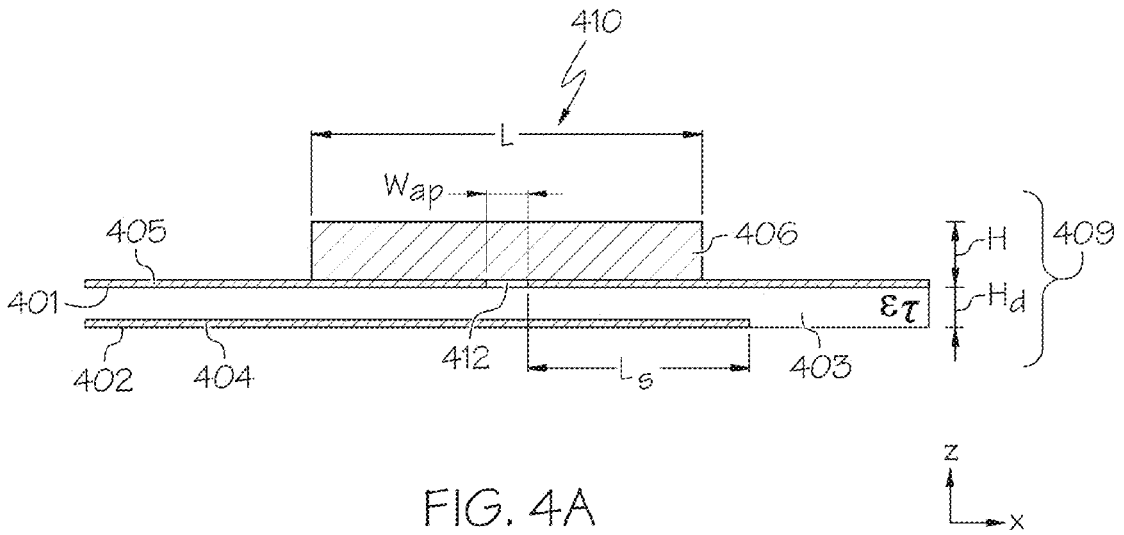
FIG. 4A illustrates a single dielectric resonator antenna (DRA) on a printed circuit board (PCB), according to various embodiments of the present inventive concepts.

Referring now to FIG. 4A, the diagram illustrates a single dielectric resonator antenna (DRA) 410 on a printed circuit board (PCB) 409. The PCB 409 includes a first conductive layer 401 and/or a second conductive layer 402. The first and second conductive layers (401, 402) may be arranged in a face-to-face relationship. The first and second conductive layers (401, 402) may be separated from one another by a dielectric layer 403. The dielectric layer 403 may be a single layer or a multilayer insulating material or a material that is a very poor conductor of electric current. The dielectric layer 403 may be formed of oxide, nitride, and/or insulating metal oxides such as hafnium oxide, aluminum oxide, and/or the like. The dielectric layer 403 may have a thickness $H_d$. A radiating element 405 may be in the first conductive layer 401. The radiating element 405 may comprise a flux couple. The radiating element 405 may include an opening or slot 412. A dielectric block 406 may be on the radiating element 405, remote from the dielectric layer 403. The dielectric block 406 may have a length L and height H. A stripline 404 may be in the second conductive layer 402 of the DRA 410. The width of the slot 412 may be $W_{ap}$. A signal may be received and/or transmitted through the stripline 404, causing the DRA 410 to resonate.

Figure 4B:
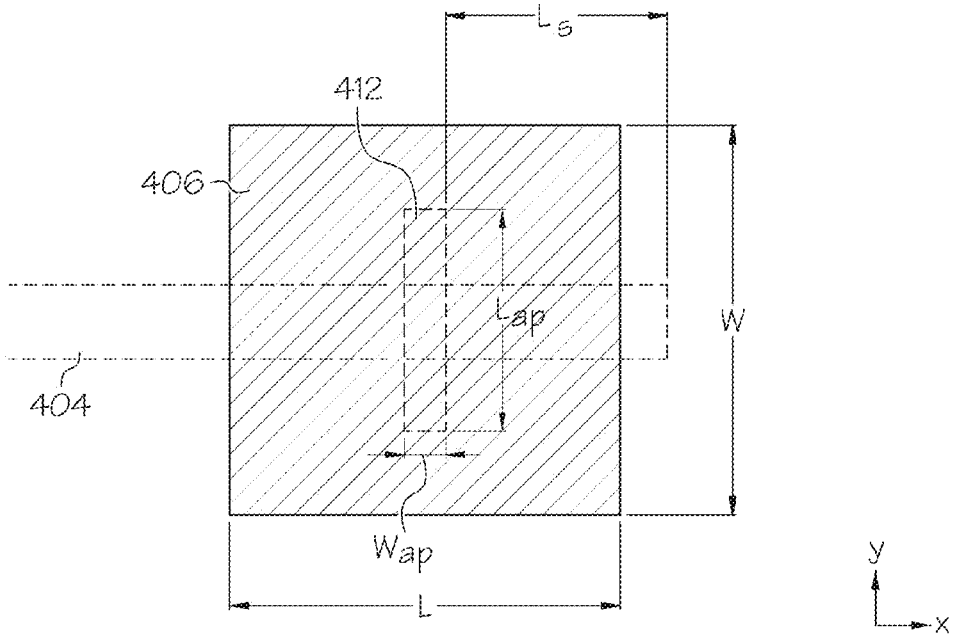
FIG. 4B illustrates a plan view of the single DRA on a printed circuit board (PCB) of FIG. 4A, according to various embodiments of the present inventive concepts.

Referring now to FIG. 4B, a plan view of the DRA 410 of FIG. 4A is illustrated. The dielectric block 406 may have a length L and width W. In some embodiments, the length L and width W may be equal. The dielectric block 406 may overlap the stripline 404. The stripline 404 may overlap a slot 412 in the radiating element 405 of the DRA 410. The slot 412 in the radiating element 405 of the DRA 410 may have a width $W_{ap}$ and/or a length $L_{ap}$. In some embodiments, the stripline 404 may extend beyond the dielectric block 406 for a length $L_s$ from the slot 412.

Electromagnetic properties of the described DRA antenna structure may be determined by physical dimensions and other parameters. For example, parameters such as stripline 404 width, stripline 404 positioning, dielectric layer 403 thickness $H_d$, dielectric layer permittivity $\varepsilon\tau$, dimensions $W_{ap}$ and/or a length $L_{ap}$ of the slot 412 in the radiating element 405, and/or dimensions L and/or W of the dielectric block 406 may affect the electromagnetic properties of DRA antenna structures and subsequently the antenna performance.

Figure 4C:
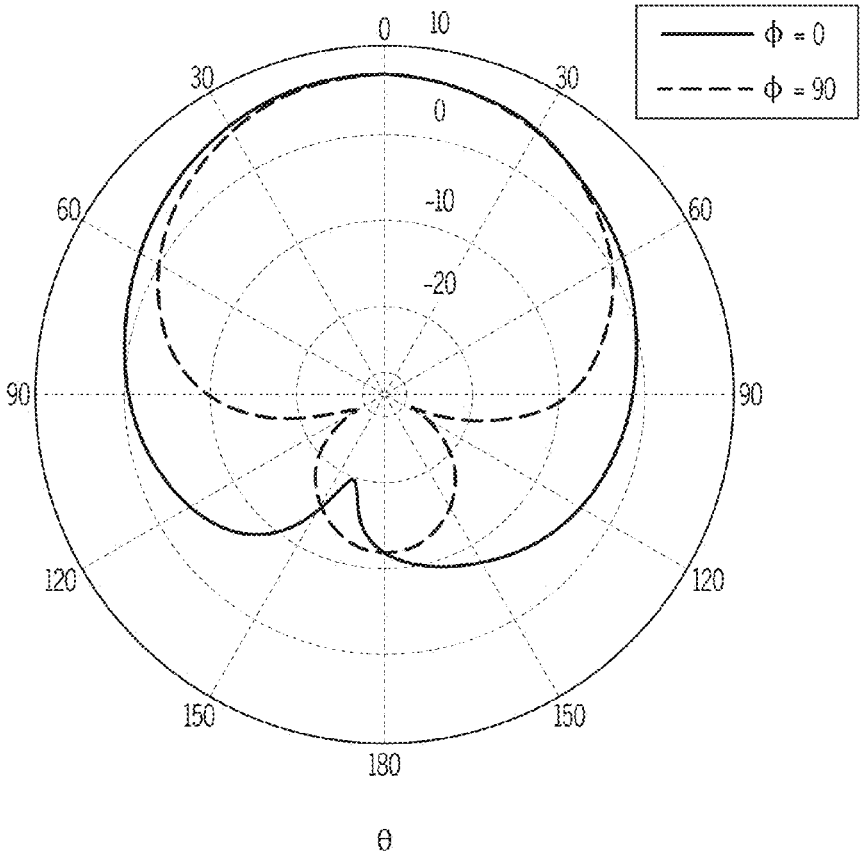
FIG. 4C illustrates the radiation pattern at two different phases of the single DRA of FIGS. 4A and 4B, according to various embodiments of the present inventive concepts.

Referring now to FIG. 4C, radiation patterns for two different phases of the DRA 410 of FIGS. 4A and 4B are illustrated. The radiation patterns at phase $\phi=0°$ and phase $\phi=90°$ are illustrated. Both radiation patterns appear to be broad and symmetric. However, the radiation patterns are directional, mostly covering one half the space around the antenna. In other words, if the DRA 410 is placed in a mobile device, one side of the mobile device would have excellent performance while the opposite side of the mobile device would have poor performance. This directional behavior of the DRA antenna may provide good performance in certain orientations with respect to a base station and/or poor performance in other orientations with respect to the base station.

Figure 5A:
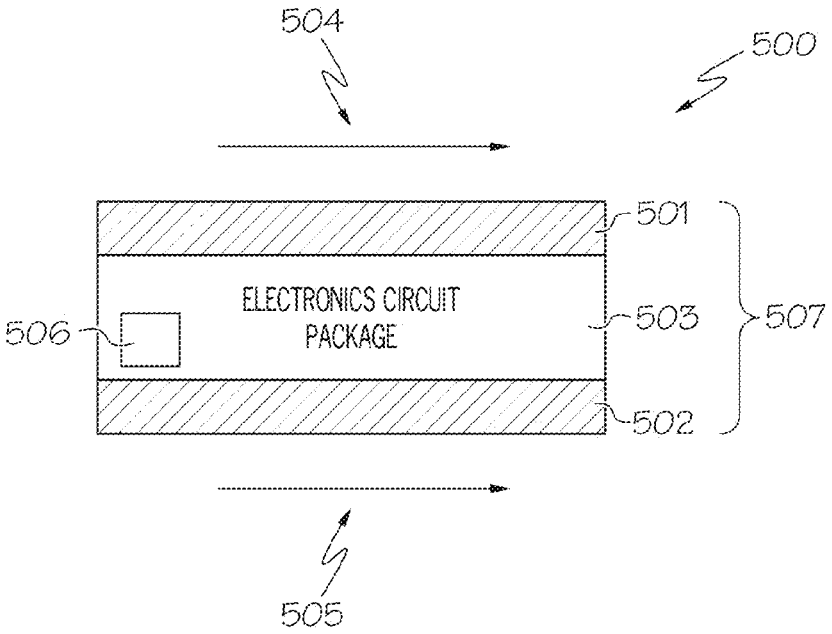
FIG. 5A illustrates a dual radiating element antenna including two radiating elements with the same polarization, according to various embodiments of the present inventive concepts.
Figure 5B:
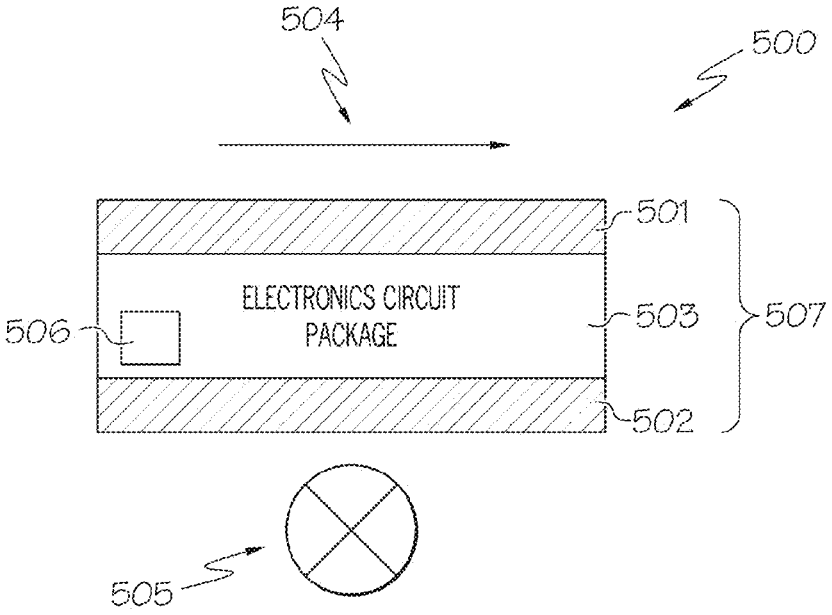
FIG. 5B illustrates a dual radiating element antenna including two radiating elements with orthogonal polarization, according to various embodiments of the present inventive concepts.

FIGS. 5A and 5B, may include the single patch antenna of FIGS. 1A and 1B, and/or the single DRA of FIGS. 4A and 4B. Referring now to FIG. 5A, a dual radiating element antenna 500 including two radiating elements with the same polarization is illustrated. The dual radiating element antenna 500 may be on a PCB 507 and include a first radiating element 501 and a second radiating element 502. An electronics circuit package 503 may be included in the PCB 507, between the first radiating element 501 and the second radiating element 502. In some embodiments, the first radiating element 501 may include the first radiating element 104 of FIG. 1A. In some embodiments, the first radiating element 501 may include the radiating element 405 of FIG. 4A. The electronics circuit package 503 may include circuits for transmitting and/or receiving signals, circuits for adjusting the polarization of signals, impedance matching circuits, and/or a power divider 506 for signal splitting and/or switching. The power divider 506 may be electrically coupled and/or connected to components in the electronics circuit package 503 and/or to a stripline associated with the dual radiating element antenna 500. Arrows 504 and 505 illustrate the respective polarizations of signals at the first radiating element 501 and the second radiating element 502. In this case, a signal at the first radiating element 501 has a same polarization 504 as the polarization 505 of a signal at the second radiating element 502. Since the first and second radiating elements 501 and 502 have the same polarization, high mutual coupling between the antenna elements may result. This high mutual coupling may result in disturbance of the signals at each of the first radiating element 501 and the second radiating element 502, causing radiation pattern distortion. In some embodiments, the signal at the first radiating element 501 may cancel and/or interfere with the signal at the second radiating element 502. In other words, in this configuration signals with the same polarization at the first and second radiating elements 501 and 502, the antenna elements may not work properly together. Changing polarization of the signals may improve performance of this antenna, as will be discussed with respect to FIG. 5B.

Referring now to FIG. 5B, a dual radiating antenna 500 including two radiating elements with orthogonal polarization is illustrated. The electronics circuit package 503 may include circuits for configuring the polarization of signals at the first and second radiating elements 501 and 502. The polarization of a signal may be associated with a physical orientation of the signal. Arrows 504 and 505 illustrate the respective polarizations of signals at the first radiating element 501 and the second radiating element 502. In this case, a signal at the first radiating element 501 has polarization 504 that is orthogonal to the polarization 505 of the signal at the second radiating element 502. Since the signal at the first radiating element 501 is orthogonal to the signal at the second radiating element 502, the antenna elements may work together to form an omni-directional radiation pattern. The radiation pattern for the upper half of the antenna at the first radiating element 501 may be orthogonal to the radiation pattern for the lower half of the antenna at the second radiating element 502, providing high isolation such as, for example −35 dB. FIG. 5B illustrates the polarization of the signals as a non-limiting example. In some embodiments, the polarization of the signal may be based on linear polarization, circular polarizations, Right Hand Circular Polarization (RHCP) or Left Hand Circular Polarization (LHCP), and/or elliptical polarization.

Still referring to FIGS. 5A and 5B, in various embodiments described herein, performance of the dual radiating antenna 500 with orthogonal signal polarization may be improved by including a power divider 506 circuit in the electronics package 503. As discussed earlier, a signal may be received and/or transmitted through the stripline associated with an antenna. A power divider 506 may be electrically connected and/or coupled to the stripline. A power divider 506 may operate to split the signal that is received and/or transmitted through the stripline. For example, a power divider 506 may be configured to control a power of the signal received at the stripline that is applied to the first radiating element 501 and/or the second radiating element 502. In other words, a first portion of the power of the signal may be applied to the first radiating element 501 for a first period of time and/or a second portion of the power of the signal may be applied to the second radiating element 502 for a second period of time. In some embodiments, the first period of time may overlap and/or be congruent in time with the second period of time. In some embodiments, the first time period may not overlap the second time period. In some embodiments, the power divider 506 may be configured to provide a first portion of the power of the signal to the first radiating element 501 that is orthogonal to the second portion of the power of the signal to the second radiating element 502. In some embodiments, the power divider 506 may be configured to provide all of the power of the signal at the stripline to the first radiating element 501 for a first period of time and to provide all of the power of the signal at the stripline to the second radiating element 502 for a second period of time. The first and second time periods may not overlap with one another when the power divider 506 switches between providing all of the power of the signal at the stripline to the first radiating element 501 or the second radiating element 502. Switching between applying power to the first radiating element 501 and the second radiating element 502 may occur periodically in time and/or according to a predefined time-based function.

In some embodiments, any of the power splitting operations may be constant over time or may vary over time. The mode of operation of the power divider 506 may switch between a first mode of providing different portions of the signal power to each of the first and second radiating elements 501 and 502 to a second mode of providing all of the power of the signal at the stripline to the first and second radiating elements 501 and 502 for different periods of time. The mode of operation of the power divider 506 may be controlled based on communication channel conditions, user selection, and/or a predetermined pattern of operation.

In some embodiments, the first and second radiating elements 501 and/or 502 of FIGS. 5A and 5B may comprise first and/or second patch elements. Now referring to FIG. 6A, a dual patch antenna 600 is illustrated. The dual patch antenna 600 may include a first conductive layer 612 and a second conductive layer 614. The first and second conductive layers (612, 614) may be arranged in a face-to-face relationship. The first and second conductive layers (612, 614) may be separated from one another by a first dielectric layer 604. A first patch element 605 may be in a fourth conductive layer 611. A second patch element 606 may be in a fifth conductive layer 613. A stripline 602 may be in the second conductive layer 612 of the dual patch antenna 600. A ground plane 601 may be in the first conductive layer 612. The ground plane may include an opening or slot 607. The width of the slot 607 may be $W_{ap}$. The width of the slot 607 may control impedance matching of the dual patch antenna 600 to the wireless electronic device 201. In some embodiments, a conductive layer 615 may be between dielectric layers 617 and 618. Conductive layer 615 may include a PCB ground plane 616 associated with a PCB. In some embodiments, the PCB ground plane 616 may include a slot 626 of width $W_{ap}$. In some embodiments, the slot 607 may overlap with the first patch element 605 and/or the second patch element 606. In some embodiments, the slot 607 may overlap with the stripline 602. In some embodiments, the slot 607 may laterally overlap with the first patch element 605 and/or the second patch element 606. In some embodiments, the slot 607 may laterally overlap with the stripline 602. A signal may be received and/or transmitted through the stripline 602, causing the dual patch antenna 600 to resonate. In some embodiments, the second patch element 606 may have a different corresponding stripline. The two striplines may each correspond to a different patch element and thus may be used by the power divider 506 of FIG. 5 to separately provide signals to the first patch element 605 and/or the second patch element 606.

Figure 6A:
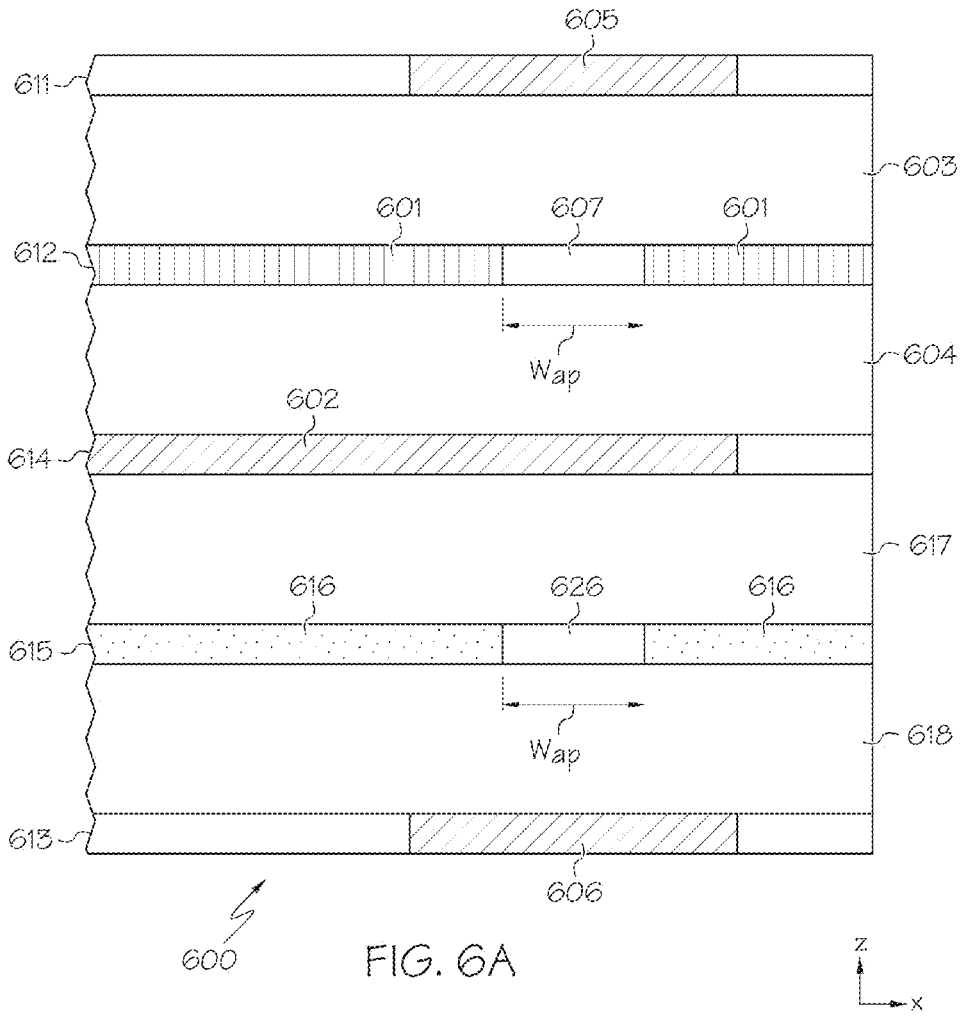
FIGS. 6A and 6B illustrate dual patch antennas, according to various embodiments of the present inventive concepts.

Still referring to FIG. 6A, a power divider may be associated with the dual patch antenna 600. The power divider is not illustrated in FIG. 6A for simplicity. The power divider may be internal or external to the dual patch antenna 600 but is electrically connected and/or coupled to the stripline 602. The power divider may be configured to control a power of the signal that is applied to the first patch element 605 and/or the second patch element 606. The first patch element 605 and/or the second patch element 606 may be configured such that a first polarization of the signal at the first patch element 605 is orthogonal to a second polarization of the signal at the second patch element 606.

In some embodiments, the first and second radiating elements 501 and/or 502 of FIGS. 5A and 5B may comprise first and/or second patch elements. Now referring to FIG. 6B, a dual patch antenna 600 is illustrated. The dual patch antenna 600 may include a first conductive layer 612 and a second conductive layer 614. The first and second conductive layers (612, 614) may be arranged in a face-to-face relationship. The first and second conductive layers (612, 614) may be separated from one another by a first dielectric layer 604. A first patch element 605 may be in a fourth conductive layer 611. The first conductive layer 612 and the fourth conductive layer 611 may be arranged in a face-to-face relationship separated by a second dielectric layer 603. A second patch element 606 may be in a fifth conductive layer 613. A stripline 602 may be in the second conductive layer 612 of the dual patch antenna 600. A ground plane 601 may be in the second conductive layer 612. The ground plane may include an opening or first slot 607. The width of the slot 607 may be $W_{ap}$. The width of the slot 607 may control impedance matching of the dual patch antenna 600 to the wireless electronic device 201. In some embodiments, the slot 607 may overlap with the first patch element 605 and/or the second patch element 606. In some embodiments, the slot 607 may overlap with the stripline 602. In some embodiments, the slot 607 may laterally overlap with the first patch element 605 and/or the second patch element 606. In some embodiments, the slot 607 may laterally overlap with the stripline 602. A signal may be received and/or transmitted through the stripline 602, causing the dual patch antenna 600 to resonate. In some embodiments, the second patch element 606 may have a different corresponding stripline 620 in a third conductive layer 619. In some embodiments, the second patch element 606 may have a different ground plane 622 in a sixth conductive layer 621. The ground plane 622 may include a second slot 623 in the sixth conductive layer 621. In some embodiments, the sixth conductive layer 621 may be separated from the third conductive layer 619 by a fourth dielectric layer 624. The sixth conductive layer 621 may be separated from the fifth conductive layer 613 by a sixth dielectric layer 625. The two striplines 602, 620 may each correspond to a different patch element 605, 606, respectively and thus may be used by the power divider 506 of FIG. 5 to separately provide signals to the first patch element 605 and/or the second patch element 606.

Figure 6B:
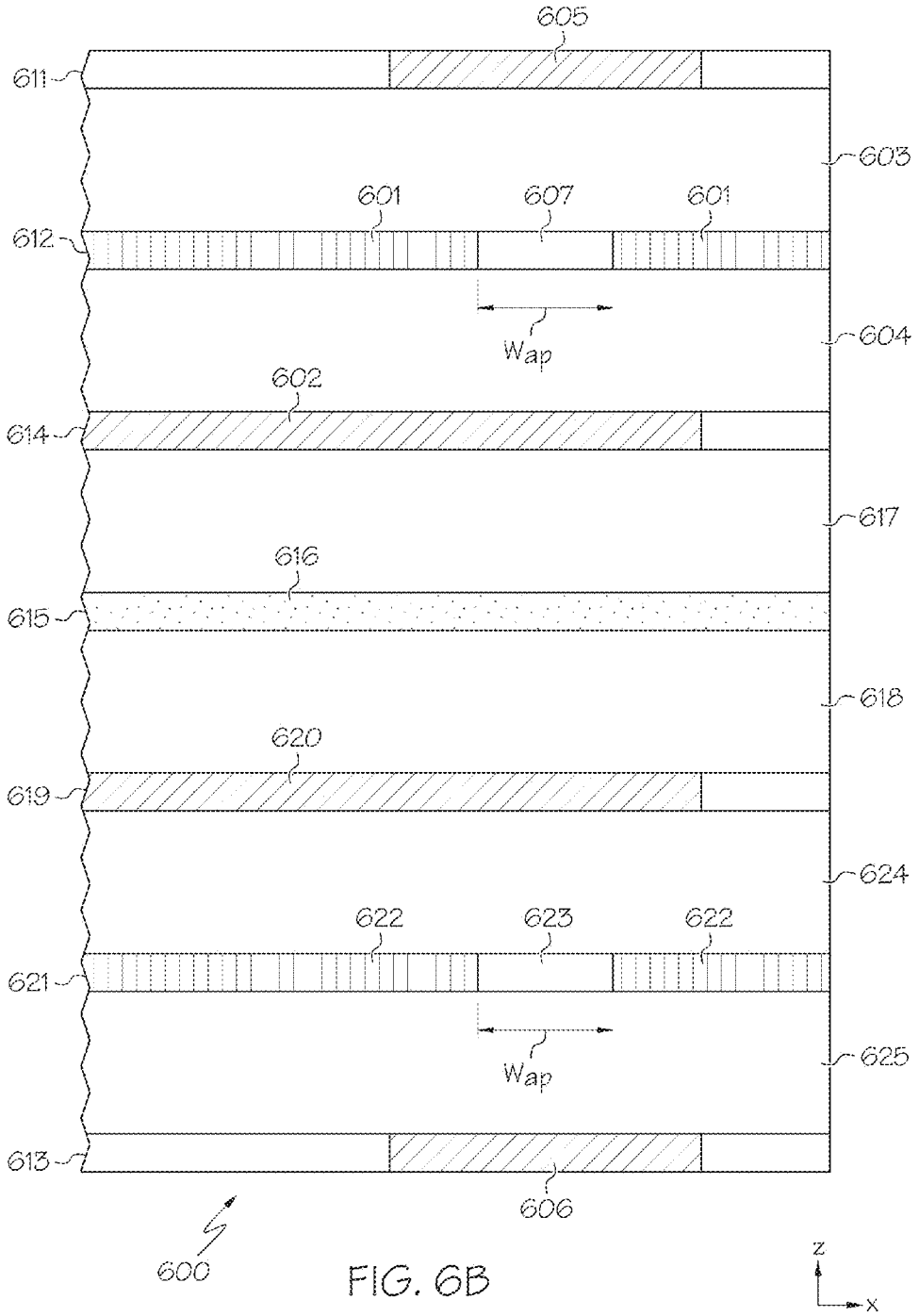

Still referring to FIG. 6B, a power divider may be associated with the dual patch antenna 600. The power divider is not illustrated in FIG. 6B for simplicity. The power divider may be internal or external to the dual patch antenna 600 but is electrically connected and/or coupled to the first stripline 602 and/or the second stripline 620. The power divider may be configured to control a power of the signal that is applied to the first patch element 605 and/or the second patch element 606. The first patch element 605 and/or the second patch element 606 may be configured such that a first polarization of the signal at the first patch element 605 is orthogonal to a second polarization of the signal at the second patch element 606.

Still referring to FIG. 6B, the dual patch antenna 600 may be included in a Printed Circuit Board (PCB). In some embodiments, the dual patch antenna 600 may include a PCB ground plane 616 in a seventh conductive layer 615. The seventh conductive layer 615 may be separated from the second conductive layer 614 by a third dielectric layer 617. The seventh conductive layer 615 may be separated from the third conductive layer 619 by a fifth dielectric layer 618.

Figure 7A:
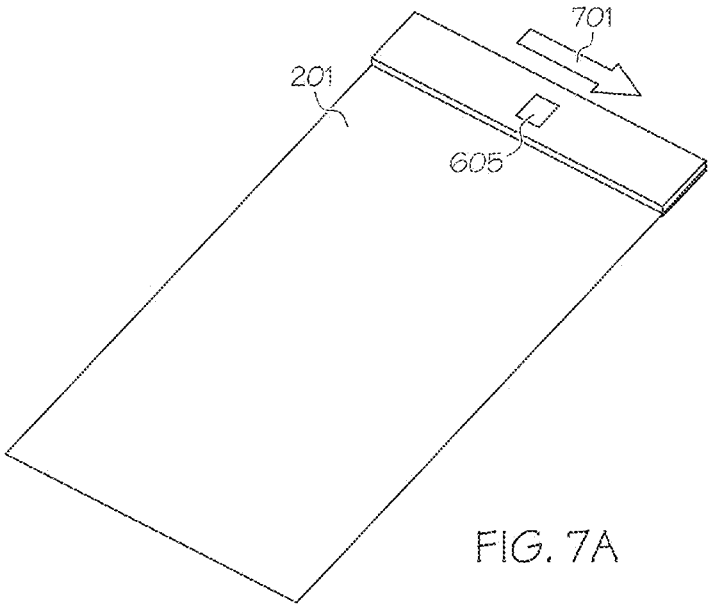
FIG. 7A illustrates the front side of a wireless electronic device such as a smartphone, including the dual patch antenna of FIG. 5B, FIG. 6A, and/or FIG. 6B according to various embodiments of the present inventive concepts.

Referring to FIG. 7A, the front side of a wireless electronic device 201, such as a smartphone, including the dual patch antenna of FIG. 5B, FIG. 6A, and/or FIG. 6B is illustrated. The wireless electronic device 201 may be oriented such that the front or top side of the mobile device is in a face-to-face relationship with the first conductive layer 611 of FIG. 6A and/or FIG. 6B. The wireless electronic device 201 may include the dual patch antenna 600 of FIG. 6A and/or FIG. 6B with first patch element 605. Arrow 701 illustrates the direction of polarization of the signals at the first patch element 605.

Figure 7B:
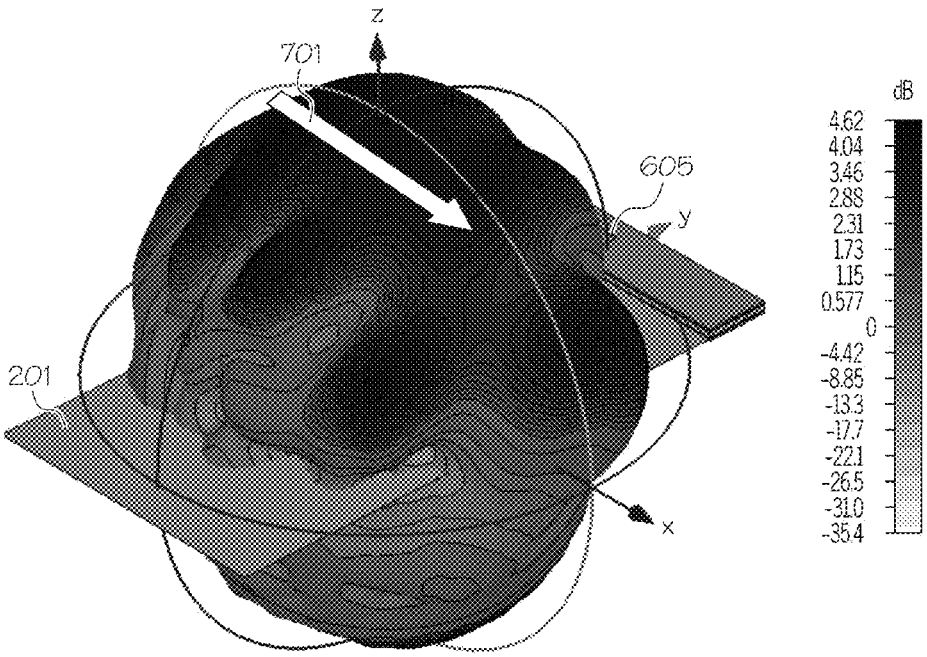
FIG. 7B illustrates the radiation pattern associated with a patch antenna element on the front side of a wireless electronic device such as a smartphone of FIG. 7A, according to various embodiments of the present inventive concepts.

Referring to FIG. 7B, the radiation pattern associated with first patch element 605 on the front side of the wireless electronic device 201 of FIG. 7A is illustrated. When the first patch element 605 is excited at 15.1 GHz, an evenly distributed radiation pattern is formed around the wireless electronic device 201. The radiation pattern around the wireless electronic device 201 exhibits little directional distortion with broad, encompassing radiation covering the space around front and back of the antenna. Although the radiation pattern of FIG. 7B is illustrated for the case when the first patch element 605 is excited, the presence of the second patch element 606 of FIG. 6A and/or FIG. 6B improves performance of the antenna by producing covering the space around both the front and the back of the antenna.

Figure 8A:
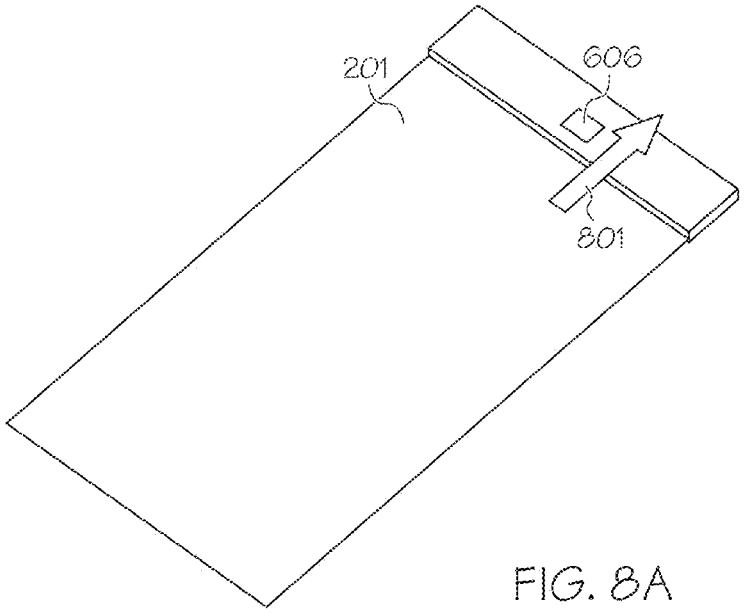
FIG. 8A illustrates the back side of a wireless electronic device such as a smartphone, including the dual patch antenna of FIG. 5B, FIG. 6A, and/or FIG. 6B according to various embodiments of the present inventive concepts.

Referring to FIG. 8A, the back side of a wireless electronic device 201, such as a smartphone, including the dual patch antenna of FIG. 5B, FIG. 6A and/or FIG. 6B, is illustrated. The wireless electronic device 201 may be oriented such that the back or bottom side of the mobile device is in a face-to-face relationship with the third conductive layer 613 of FIG. 6A and/or FIG. 6B. The wireless electronic device 201 may include the dual patch antenna 600 of FIG. 6A and/or FIG. 6B with second patch element 606. Arrow 801 illustrates the direction of polarization of the signals at the second patch element 606. The polarization 701 of the first patch element 605 of FIG. 7A is orthogonal to the polarization 801 of the second patch element 606 of FIG. 8A.

Figure 8B:
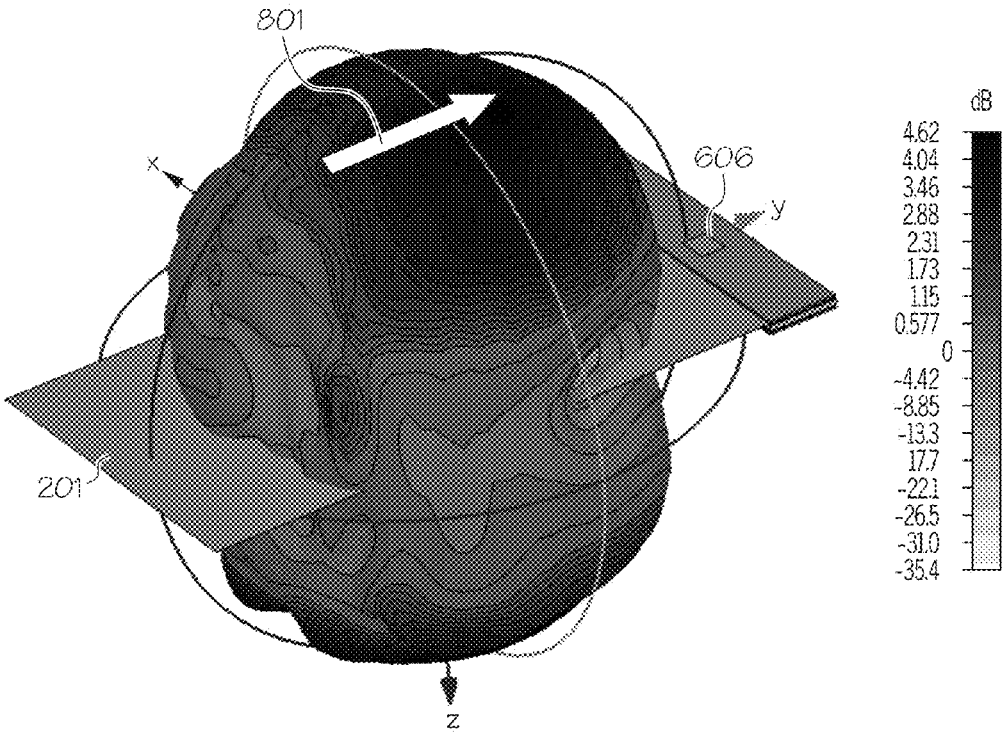
FIG. 8B illustrates the radiation pattern associated with a patch antenna element on the back side of a wireless electronic device such as a smartphone of FIG. 8A, according to various embodiments of the present inventive concepts.

Referring to FIG. 8B, the radiation pattern associated with second patch element 606 on the back side of the wireless electronic device 201 of FIG. 8A is illustrated. When the second patch element 606 is excited at 15.1 GHz, an evenly distributed radiation pattern is formed around the wireless electronic device 201. The radiation pattern around the wireless electronic device 201 exhibits little directional distortion with broad, encompassing radiation covering the space around both the front and back of the antenna. Although the radiation pattern of FIG. 8B is illustrated for the case when the second patch element 606 is excited, the presence of the first patch element 605 of FIG. 6A and/or FIG. 6B improves performance of the antenna by producing covering the space around both the front and the back of the antenna.

Figure 9:
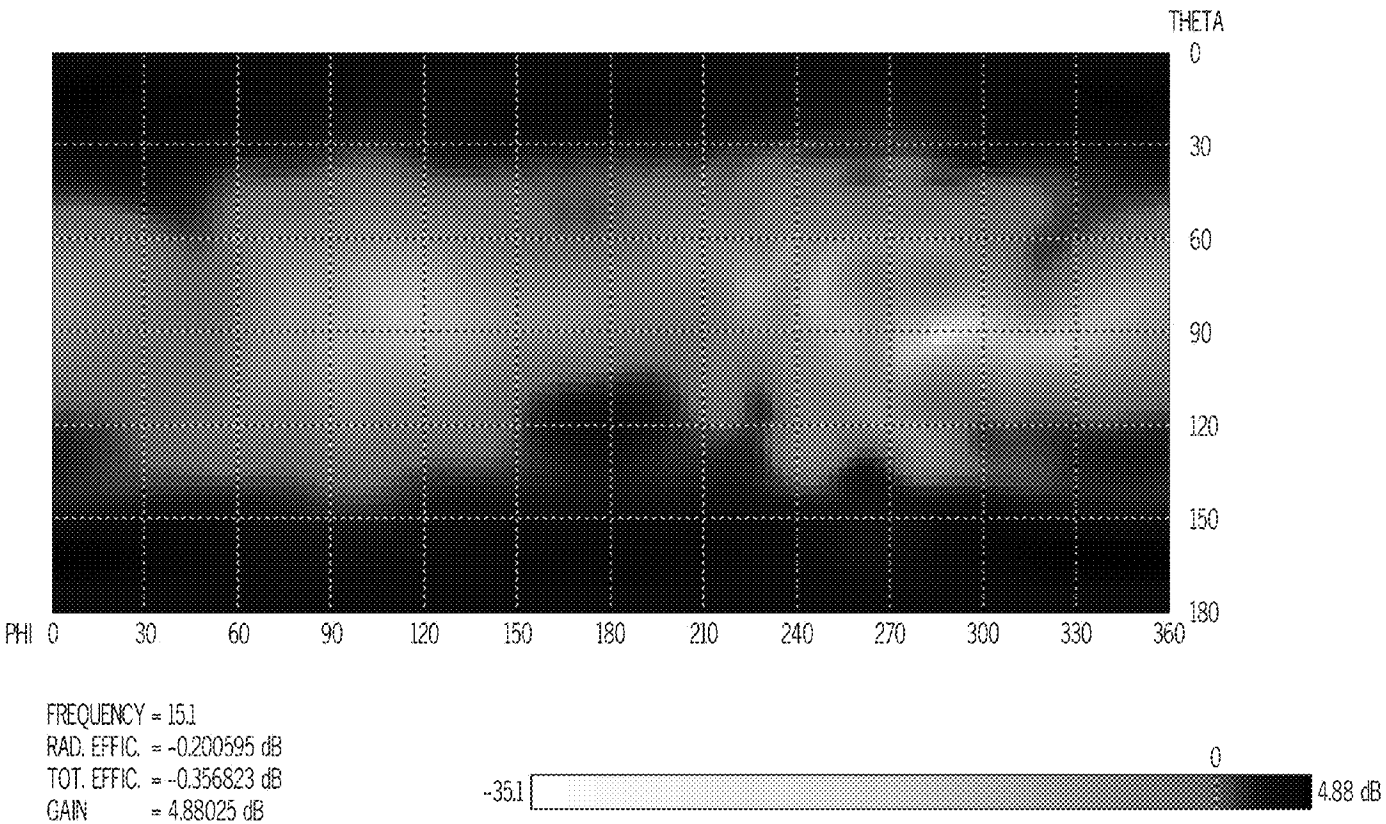
FIG. 9 illustrates the absolute far field gain, at 15.1 GHz excitation, along a wireless electronic device including the dual patch antenna of FIG. 6A and/or FIG. 6B, according to various embodiments of the present inventive concepts.

Referring to FIG. 9, the absolute far field gain, at 15.1 GHz excitation, along a wireless electronic device including the dual patch antenna of FIG. 6A and/or FIG. 6B, is illustrated. The absolute far field gain of FIG. 9 is associated with simultaneous excitation from a power divider applied to both the first patch element 605 and the second patch element 606 of the dual patch antennas of FIGS. 6 to 8B. In this case, approximately half the signal power was provided to excite the first patch element 605 and approximately half the signal power was provide to excite the second patch element 606.

Still referring to FIG. 9, the axis Theta represents the y-z plane while the axis Phi represents the x-y plane around the wireless electronic device 201of FIGS. 7A and 7B. The absolute far field gain exhibits satisfactory gain characteristics in directions radiating from both the front face and the back face of the wireless electronic device 201. For example, excellent gain characteristics with −35 dB isolation may be obtained in both directions of the z-axis. However, the far field gain appears to be less in both directions of the x-axis, corresponding to the sides of the mobile device. Compared to the single patch antenna of FIGS. 3A and 3B, FIGS. 7A and 7B illustrate that the dual patch antenna may provide significantly larger coverage space due to the effects of the first and second patch elements 605 and 606 and/or orthogonal polarization of signals. In other words, the single patch antenna produced a radiation pattern that was substantially directed from one direction (i.e. from one face) of the mobile device whereas the dual patch antenna produces a radiation pattern that is substantially directed from two different directions, for example, from both the front and back faces of the mobile device.

Figure 10A:
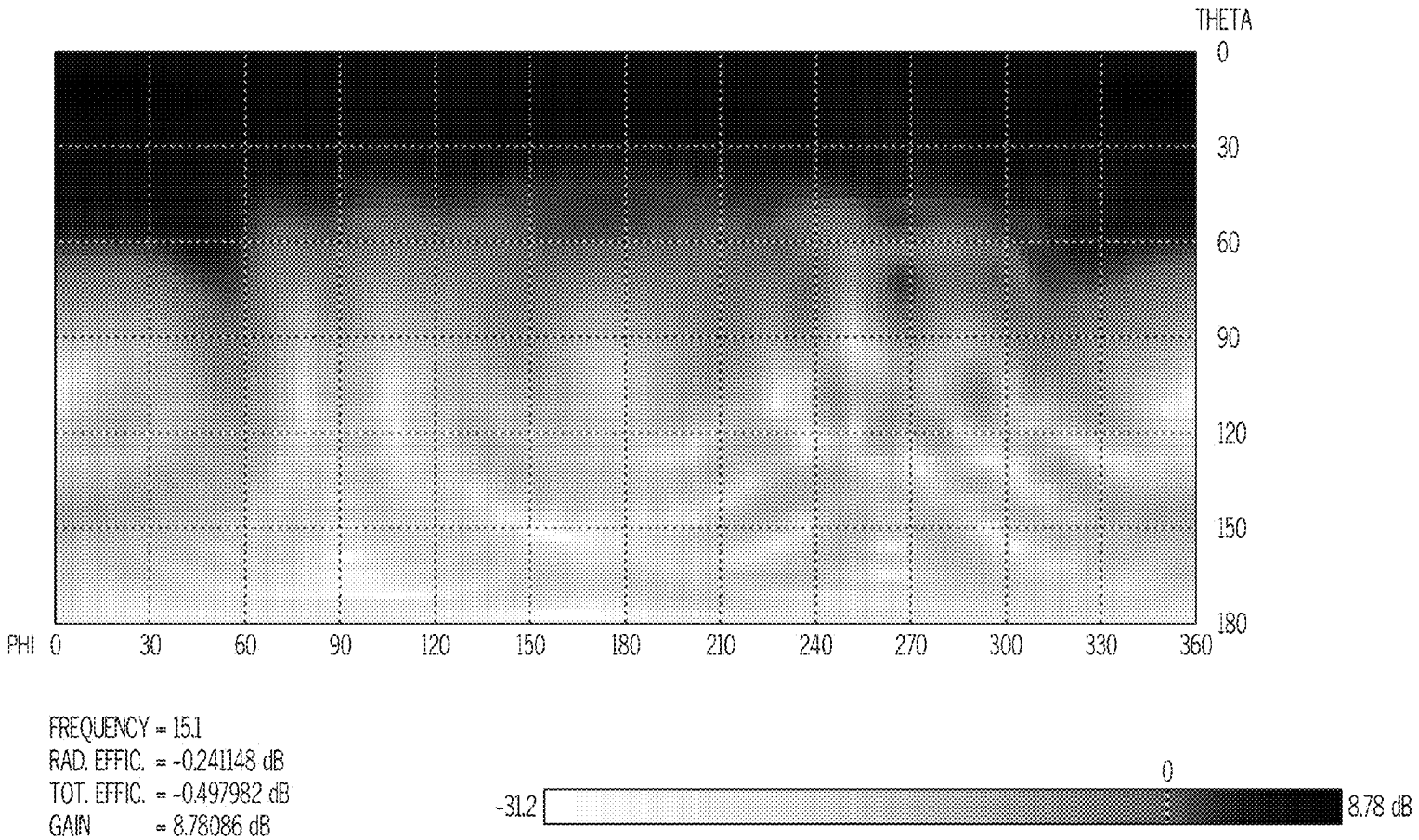
FIGS. 10A and 10B illustrate the absolute far field gain using different signal feeding schemes, at 15.1 GHz excitation, along a wireless electronic device including the dual patch antenna of FIG. 6A and/or FIG. 6B, according to various embodiments of the present inventive concepts.
Figure 10B:
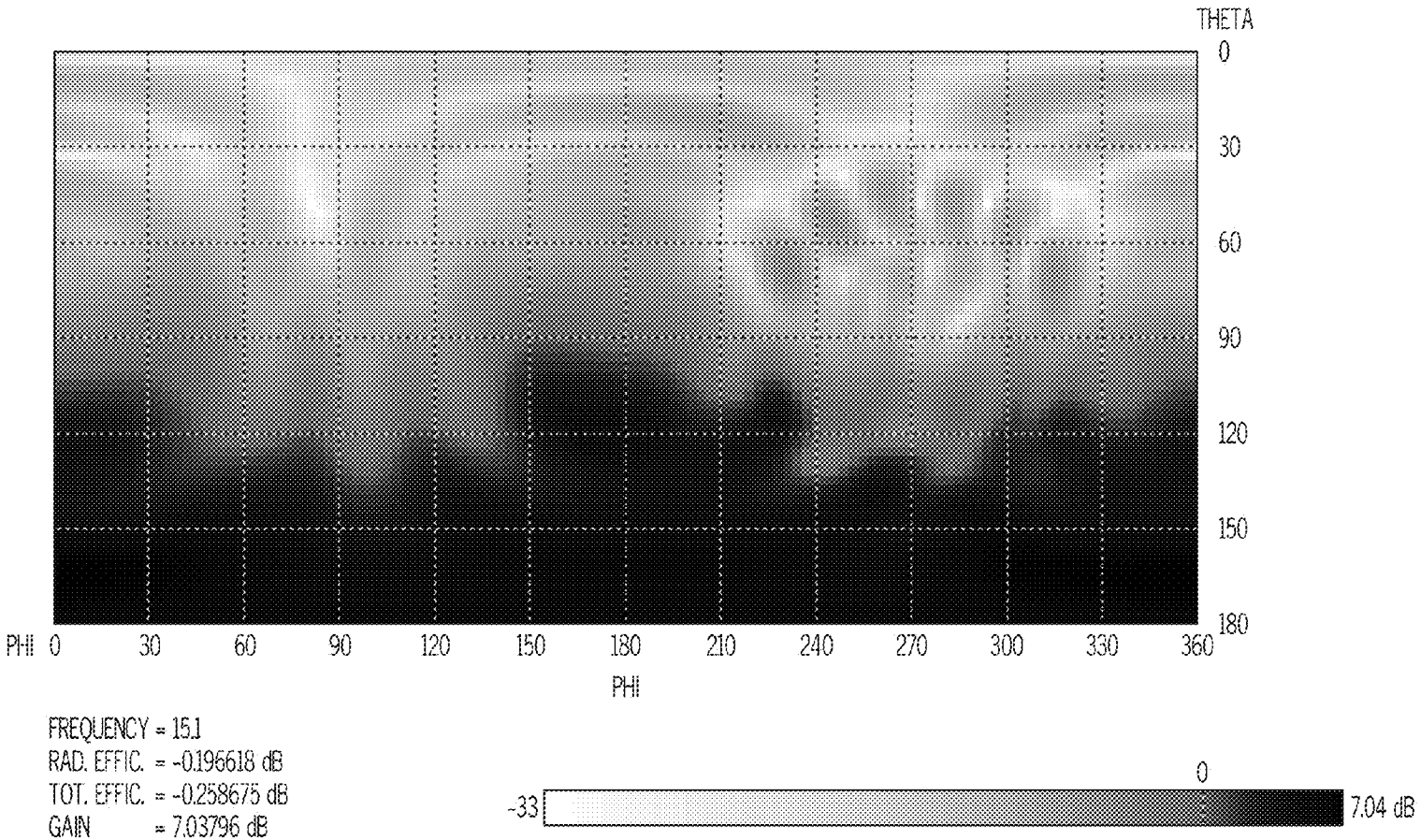

FIGS. 10A and 10B illustrate the absolute far field gain using different signal feeding schemes, at 15.1 GHz excitation, along a wireless electronic device including the dual patch antenna of FIG. 6A and/or FIG. 6B. As discussed in detail above, a power divider may be used to switch the signal excitation between the first and second patch elements 605 and 606. In this example configuration, the power divider provides most of the power of the signal to the first patch element 605 of FIG. 6A and/or FIG. 6B for a first period of time, illustrated in the results of FIG. 10A. The power divider may provide most of the power of the signal to the second patch element 606 of FIG. 6A and/or FIG. 6B for a second period of time, illustrated in the results of FIG. 10B. Compared to the approximately equal power division of FIG. 9, the peak gain increases by 2 dB-3 dB when using this switching feeding scheme. The switch feeding scheme may tune the antenna to better fit channel characteristics such as periodic noise disturbances. In some embodiments, switching the feeding from the first patch element to the second patch element may be based on directional channel measurements. For example, a pilot signal from a base station may be used to determine better performance between feeding to the first patch element versus the second patch element.

Referring to FIG. 11A, a dual dielectric resonator antenna (DRA) 1100 is illustrated. The dual DRA 1100 may include a first conductive layer 1112 and a second conductive layer 1114. The first and second conductive layers (1112, 1114) may be arranged in a face-to-face relationship. The first and second conductive layers (1112, 1114) may be separated from one another by a first dielectric layer 1104. A first flux couple may be in the first conductive layer 1112. A second flux couple may be in a fourth conductive layer 1121. A first dielectric block 1108 may be on the first conductive layer 1112, opposite the first dielectric layer 1104. A second dielectric block 1109 may be on the fourth conductive layer 1121, opposite a fourth dielectric layer 1118. A stripline 1102 may be in the second conductive layer 1114 of the dual DRA 1100. A ground plane 1101 may be in the second conductive layer 1112. The ground plane 1101 may include an opening or slot 1107. The width of the slot 1107 may be $W_{ap}$. In some embodiments, the slot 1107 may laterally overlap the first dielectric block 1108 and/or the second dielectric block 1109. In some embodiments, the slot 1107 may overlap the stripline 1102. A signal may be received and/or transmitted through the stripline 1102, causing the dual DRA 1100 to resonate. Some embodiments may include a ground plane 1120 including a second slot 1110 in the fourth conductive layer 1121. In some embodiments, the first dielectric block 1108 may overlap the first slot 1107 and/or the second dielectric block 1109 may overlap the second slot 1110. In some embodiments, factors such as the relative permittivity of the first dielectric block 1108 and/or the second dielectric block 1109 may affect the electromagnetic properties of the dual DRA antenna 1100 and/or subsequently affect the antenna performance. In some embodiments, the first radiating element 501 of FIG. 5B may include a first flux couple and/or the first dielectric block 1108 of FIG. 11A. Similarly, the second radiating element 502 of FIG. 5B may include a second flux couple and/or the second dielectric block 1109 of FIG. 11A. The dual DRA 1100 of FIG. 11A provides similar performance results as illustrated in FIGS. 7B, 8B, 9, 10A, and/or 10B. In some embodiments, the dual DRA 1100 of FIG. 11A may provide better performance with wider bandwidth when compared to the dual path antenna 600 of FIG. 6A and/or FIG. 6B.

Still referring to FIG. 11A, a power divider may be associated with the DRA 1100. The power divider is not illustrated in FIG. 11A for simplicity. The power divider may be internal or external to the DRA 1100 but is electrically connected and/or coupled to the stripline 1102. The power divider may be configured to control a power of the signal that is applied to the first dielectric block 1108 and/or the second dielectric block 1109. The first dielectric block 1108 and/or the second dielectric block 1109 may be configured such that a first polarization of the signal at the first dielectric block 1108 is orthogonal to a second polarization of the signal at the second dielectric block 1109.

Figure 11B:
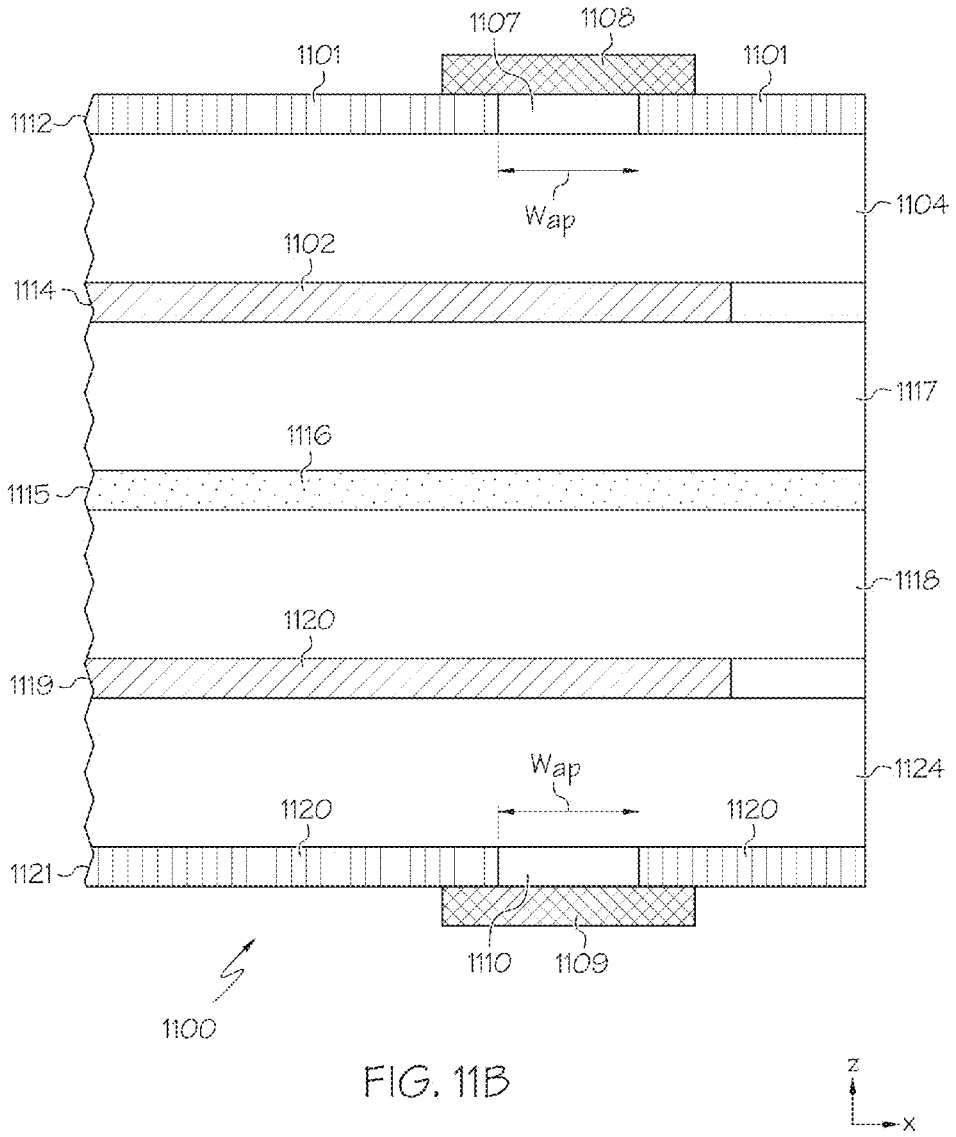

Referring to FIG. 11B, a dual dielectric resonator antenna (DRA) 1100 is illustrated. The dual DRA 1100 may include a first conductive layer 1112 and a second conductive layer 1114. The first and second conductive layers (1112, 1114) may be arranged in a face-to-face relationship. The first and second conductive layers (1112, 1114) may be separated from one another by a first dielectric layer 1104. A first flux couple may be in the first conductive layer 1112. A second flux couple may be in a fourth conductive layer 1121. A first dielectric block 1108 may be on the first conductive layer 1112, opposite the first dielectric layer 1104. A second dielectric block 1109 may be on the fourth conductive layer 1121, opposite a fourth dielectric layer 1118. A stripline 1102 may be in the second conductive layer 1114 of the dual DRA 1100. A ground plane 1101 may be in the second conductive layer 1112. The ground plane 1101 may include an opening or slot 1107. The width of the slot 1107 may be $W_{ap}$. In some embodiments, the slot 1107 may laterally overlap the first dielectric block 1108 and/or the second dielectric block 1109. In some embodiments, the slot 1107 may overlap the stripline 1102. A signal may be received and/or transmitted through the stripline 1102, causing the dual DRA 1100 to resonate. Some embodiments may include a ground plane 1120 including a second slot 1110 in the fourth conductive layer 1121. In some embodiments, the first dielectric block 1108 may overlap the first slot 1107 and/or the second dielectric block 1109 may overlap the second slot 1110. In some embodiments, a second stripline 1120 may be included in a third conductive layer 1119. The third conductive layer 1119 may be separated from the sixth conductive layer 1121 by a fourth dielectric layer 1124.

Still referring to FIG. 11B, the dual DRA 1100 may be included in a Printed Circuit Board (PCB). In some embodiments, the dual DRA 1100 may include a PCB ground plane 1116 in a seventh conductive layer 1115. The seventh conductive layer 1115 may be separated from the second conductive layer 1114 by a third dielectric layer 1117. The seventh conductive layer 1115 may be separated from the third conductive layer 1119 by a fifth dielectric layer 1118.

In some embodiments, factors such as the relative permittivity of the first dielectric block 1108 and/or the second dielectric block 1109 may affect the electromagnetic properties of the dual DRA antenna 1100 and/or subsequently affect the antenna performance. In some embodiments, the first radiating element 501 of FIG. 5B may include a first flux couple and/or the first dielectric block 1108 of FIG. 11B. Similarly, the second radiating element 502 of FIG. 5B may include a second flux couple and/or the second dielectric block 1109 of FIG. 11B. The dual DRA 1100 of FIG. 11B provides similar performance results as illustrated in FIGS. 7B, 8B, 9, 10A, and/or 10B. In some embodiments, the dual DRA 1100 of FIG. 11B may provide better performance with wider bandwidth when compared to the dual path antenna 600 of FIG. 6A and/or FIG. 6B.

Still referring to FIG. 11B, a power divider may be associated with the DRA 1100. The power divider is not illustrated in FIG. 11B for simplicity. The power divider may be internal or external to the DRA 1100 but is electrically connected and/or coupled to the stripline 1102. The power divider may be configured to control a power of the signal that is applied to the first dielectric block 1108 and/or the second dielectric block 1109. The first dielectric block 1108 and/or the second dielectric block 1109 may be configured such that a first polarization of the signal at the first dielectric block 1108 is orthogonal to a second polarization of the signal at the second dielectric block 1109.

Figure 12A:
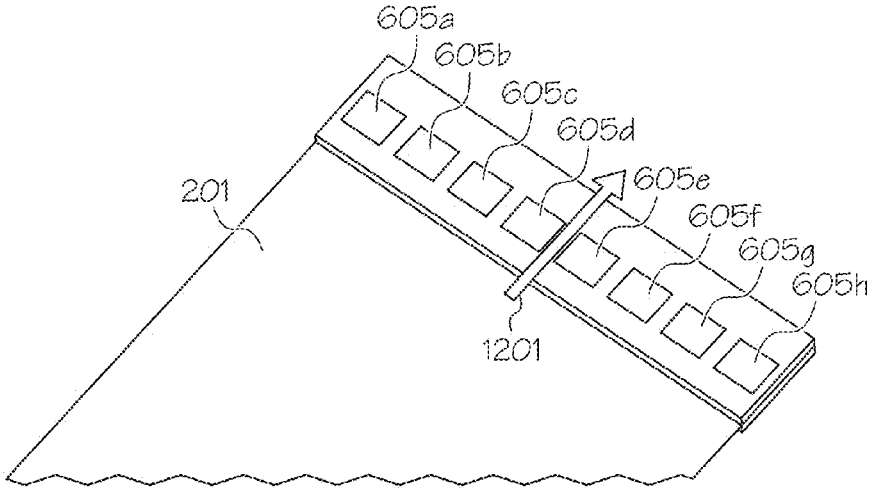
FIG. 12A illustrates the front side of a wireless electronic device such as a smartphone, including an array of dual patch antenna elements of FIG. 6A and/or FIG. 6B, according to various embodiments of the present inventive concepts.
Figure 12B:
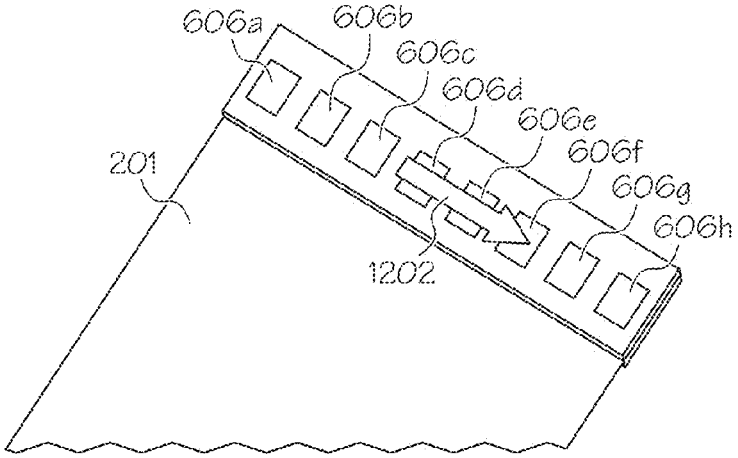
FIG. 12B illustrates the back side of a wireless electronic device such as a smartphone, including an array of dual patch antenna elements of FIG. 6A and/or FIG. 6B, according to various embodiments of the present inventive concepts.

FIGS. 12A and 12B illustrate a wireless electronic device 201 such as a smartphone including an array of dual patch antennas of FIG. 6A and/or FIG. 6B. Referring to FIG. 12A, the front side of a wireless electronic device 201 including an array of first patch antenna elements 605*a*-605*h* is illustrated. The polarization of the signals at first patch antenna elements 605*a*-605*h* is indicated by arrow 1201. Now referring to FIG. 12B, the back side of a wireless electronic device 201 including an array of second patch elements 606*a*-606*h* is illustrated. The polarization of the signals at second patch antenna elements 606*a*-606*h* is indicated by arrow 1202. In some embodiments, polarization 1201 may be orthogonal to polarization 1202. Although FIGS. 12A and 12B are described in the context of the dual patch antenna of FIG. 6A and/or FIG. 6B as a non-limiting example, the array may include the first and second radiating elements of FIGS. 5A and 5B, and/or the first and second flux couples and first and second dielectric blocks of the DRA antenna of FIG. 11A, according to some embodiments.

Figure 13A:
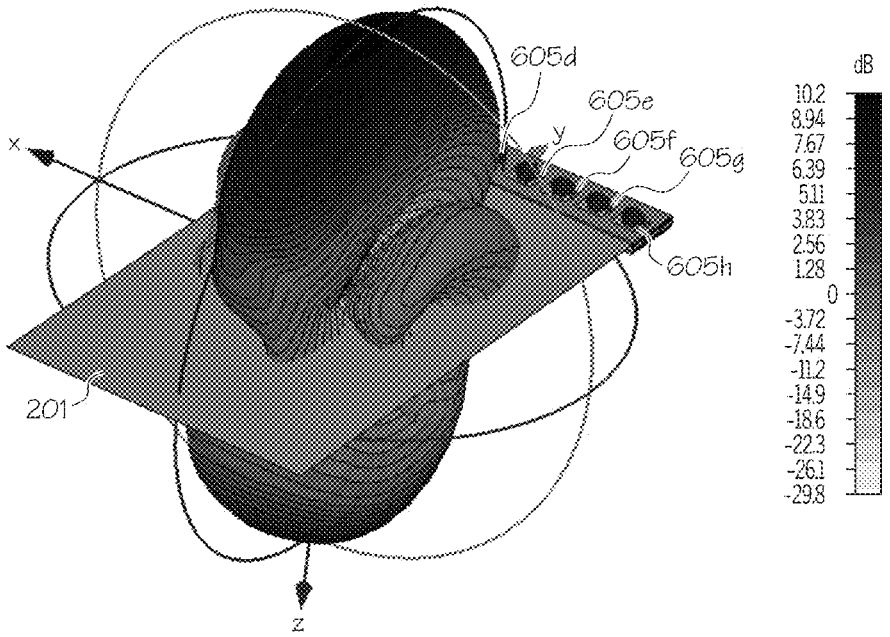
FIGS. 13A-13C illustrate the radiation pattern around the wireless electronic device, including a dual patch array antenna of FIGS. 12A and 12B, according to various embodiments of the present inventive concepts.
Figure 13B:
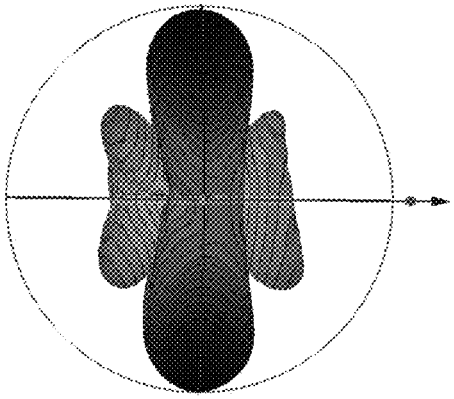
Figure 13C:
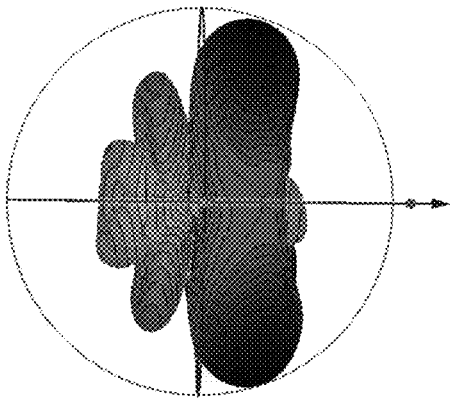

FIGS. 13A-13C illustrate the radiation pattern around the wireless electronic device 201, including a dual patch array antenna of FIGS. 12A and 12B. Referring to FIG. 13A, when the dual patch array antenna is excited, an evenly distributed radiation pattern is formed around the wireless electronic device 201. The radiation pattern around the wireless electronic device 201 exhibits little directional distortion along the z-axis with broad, encompassing radiation, symmetrically covering the space around the front side and back side of the wireless electronic device 201. Referring to FIGS. 13B and 13C, although a broad radiation pattern is exhibited in FIG. 13A with respect to the front and back faces of the wireless electronic device 201, poor gain characteristics and distortion may be present in the direction of the x-axis.

Figure 14:
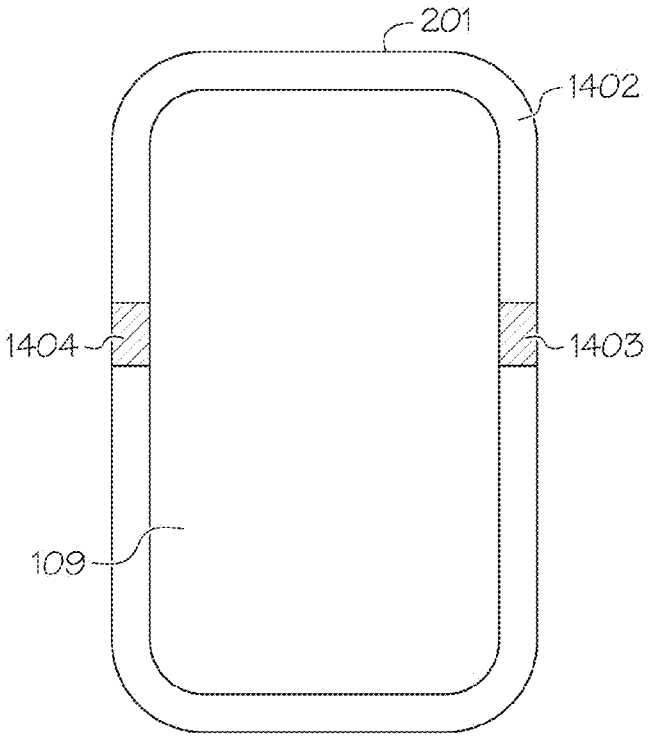
FIG. 14 illustrates a wireless electronic device with a metal ring antenna, according to various embodiments of the present inventive concepts.

The dual patch antenna and/or the dual DRA described herein may be suitable for use at millimeter band radio frequencies in the electromagnetic spectrum, for example, from 10 GHz to 300 GHz. In some embodiments, if may be desirable for the wireless electronic device 201 to transmit and/or receive signals in the cellular band of 850 to 1900 MHz. Referring now to FIG. 14, a wireless electronic device 201 including a metal ring antenna 1402 is illustrated. The metal ring antenna may extend along an outer edge of the PCB 109. The metal ring antenna may be spaced apart and electrically isolated from the PCB 109. The metal ring antenna 1402 may be coupled to PCB 109 through grounding components 1403 and 1404. The metal ring antenna may be configured to resonate at a frequency in the cellular band of 850 to 1900 MHz that is different from the millimeter band of the dual patch antenna and/or the dual DRA.

Figure 15:
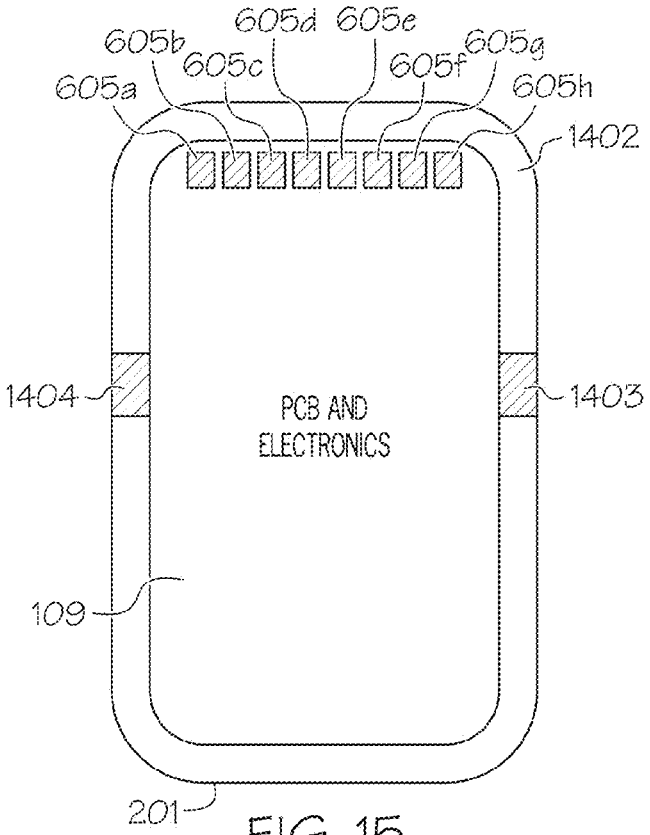
FIG. 15 illustrates a wireless electronic device with a metal ring antenna as well as dual radiating element array antenna, according to various embodiments of the present inventive concepts.

Referring to FIG. 15, a wireless electronic device 201 with the metal ring antenna 1402 of FIG. 14 as well as the dual patch array antenna of FIGS. 12A and 12B is illustrated. FIG. 15 illustrates a front view of the mobile device and thus illustrates first patch antenna elements 605*a*-605*h*. Corresponding second patch antenna elements may be located on the back side of the wireless electronic device 201. Although FIG. 15 is described in the context of the dual patch antenna array of FIGS. 12A and 12B as a non-limiting example, the array may include the first and second radiating elements of FIGS. 5A and 5B, and/or the first and second flux couples of FIG. 11A and/or the first and second dielectric blocks of the DRA antenna of FIG. 11A, according to some embodiments.

Figure 16:
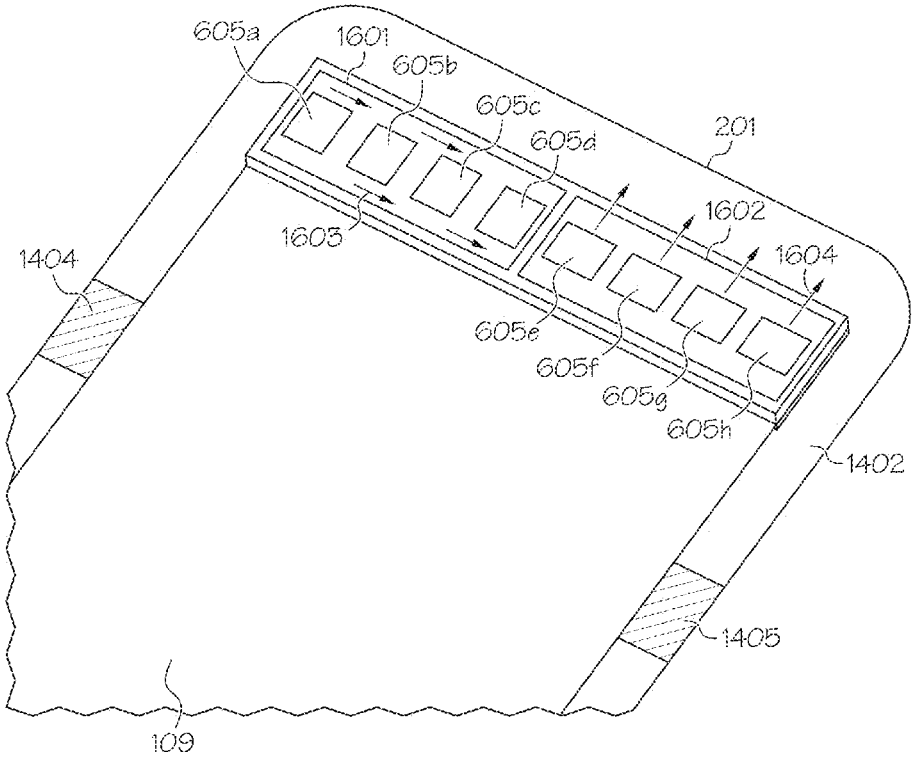
FIG. 16 illustrates a wireless electronic device with a metal ring antenna as well as dual radiating element MIMO array antenna, according to various embodiments of the present inventive concepts.

Referring to FIG. 16, a wireless electronic device with a metal ring antenna as well as a dual patch Multiple Input and Multiple Output (MIMO) array antenna is illustrated. FIG. 16 illustrates the dual patch array antenna of FIG. 15, with an array dual patch antennas configured in subarrays for MIMO operation. For example, patch antenna elements 605*a* to 605*d* comprise MIMO subarray 1601 whereas patch antenna elements 605*e* to 605*h* comprise MIMO subarray 1602. Although not illustrated in FIG. 16, corresponding second patch antenna elements 606*a* to 606*h* may be present on the back side of the wireless electronic device 201. Arrows 1603 indicate the direction of polarization of MIMO subarray 1601 whereas arrows 1604 indicates the direction of polarization of MIMO subarray 1602. Corresponding second patch antenna elements 606*a* to 606*d* on the back of the wireless electronic device 201 and associated with MIMO subarray 1601, may have a direction of polarization that is orthogonal to the direction indicated by 1603. Likewise, corresponding second patch antenna elements 606*e* to 606*h* on the back of the wireless electronic device 201 and associated with MIMO subarray 1602, may have a direction of polarization that is orthogonal to the direction indicated by 1604. Although FIG. 16 is described in the context of the dual patch antenna of FIG. 6A and/or FIG. 6B as a non-limiting example, the MIMO array antenna may include the first and second radiating elements of FIGS. 5A and 5B, and/or the first and second flux couples of FIG. 11A and/or the first and second dielectric blocks of the DRA antenna of FIG. 11B, according to some embodiments.

Figure 17A:
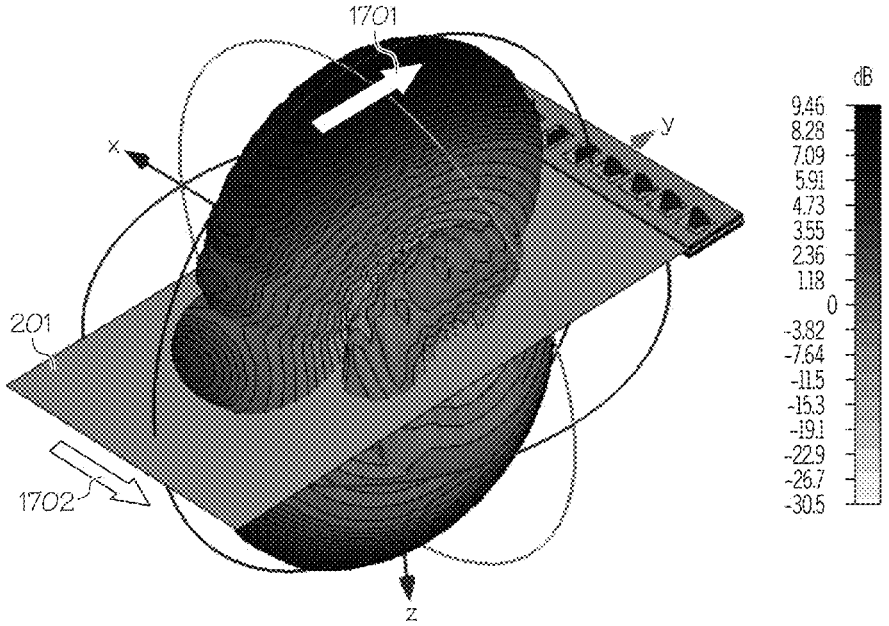
FIGS. 17A and 17B illustrate the radiation patterns around the wireless electronic device for various subarrays of the dual patch MIMO array antenna including the antenna of FIG. 16, according to various embodiments of the present inventive concepts.

Referring to FIG. 17A, the radiation patterns around the wireless electronic device 201 for the dual patch MIMO subarray 1601 of FIG. 16 is illustrated. Arrow 1701 indicates the polarization of the first patch antenna elements in the dual patch MIMO subarray 1601 and arrow 1702 indicates the polarization of the second patch antenna elements in the dual patch MIMO subarray 1601. The radiation pattern around the wireless electronic device 201 exhibits little directional distortion on the z-axis with broad, encompassing radiation covering the space around the front side and back side of the wireless electronic device 201.

Figure 17B:
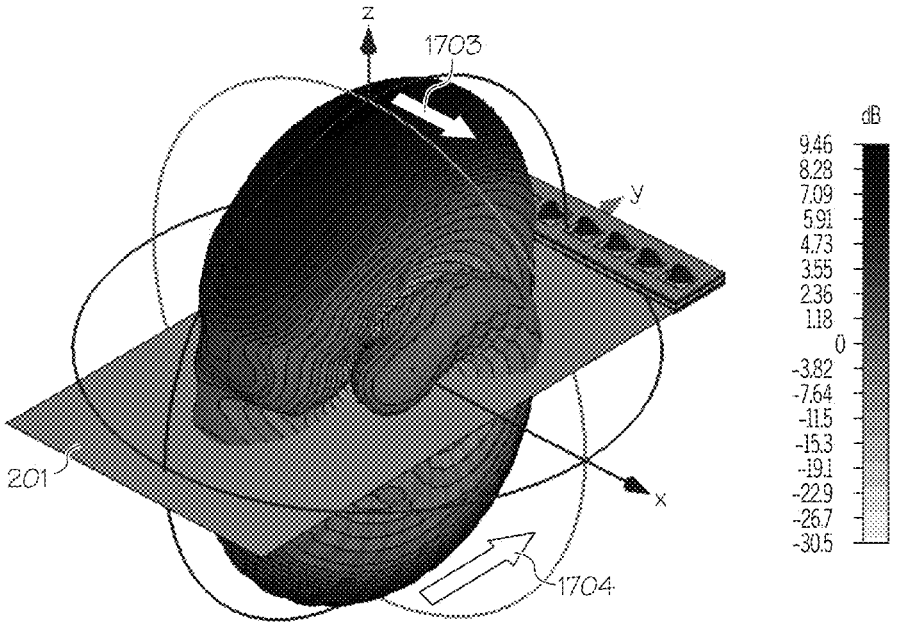

Referring to FIG. 17B, the radiation patterns around the wireless electronic device 201 for dual patch MIMO subarray 1602 of FIG. 16 is illustrated. Arrow 1703 indicates the polarization of the first patch antenna elements in the dual patch MIMO subarray 1602 and arrow 1704 indicates the polarization of the second patch antenna elements in the dual patch MIMO subarray 1602. The radiation pattern around the wireless electronic device 201 exhibits little directional distortion on the z-axis with broad, encompassing radiation covering the space around the front side and back side of the wireless electronic device 201.

Figure 18:
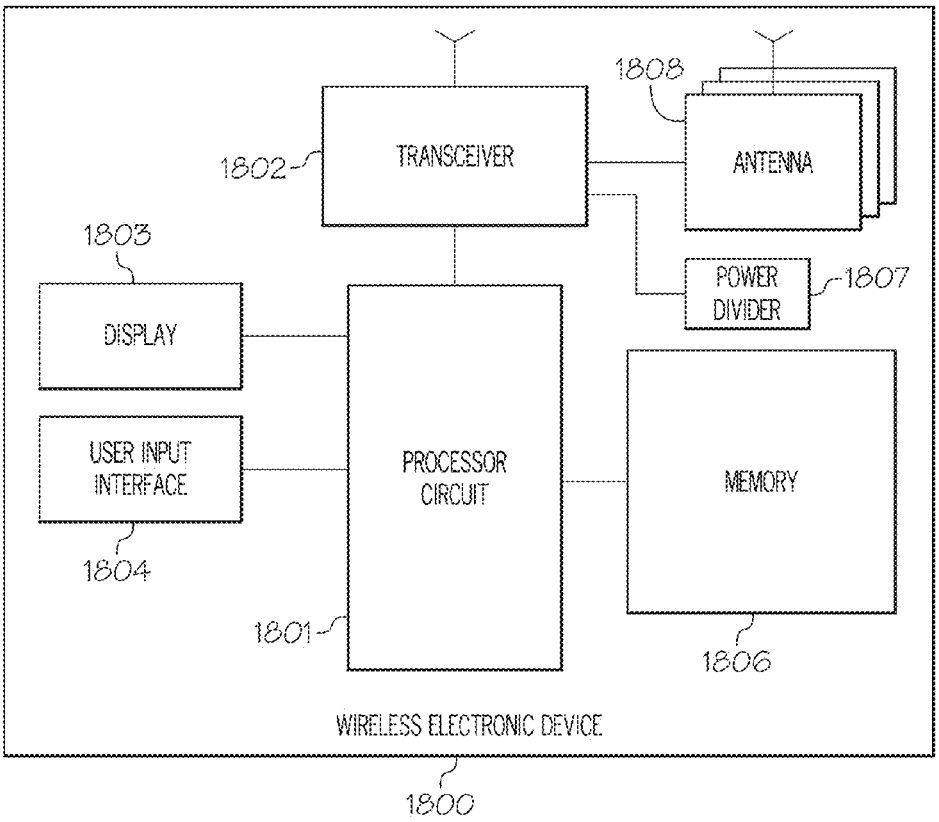
FIG. 18 illustrates a wireless electronic device such as a cell phone including one or more antennas according to any of FIGS. 1 to 17B, according to various embodiments of the present inventive concepts.

Referring to FIG. 18, a wireless electronic device 1800 such as a cell phone including one or more antennas according to any of FIGS. 1 to 17B is illustrated. The wireless electronic device 1800 may include a processor 1801 for controlling the transceiver 1802, power divider 1807, and/or one or more antennas 1808. The one or more antenna 1808 may include the patch antenna 600 of FIG. 6A and/or FIG. 6B, the DRA 1100 of FIG. 11A and/or FIG. 11B, and/or the metal ring antenna 1402 of FIGS. 14 to 16. The wireless electronic device 1800 may include a display 1803, a user interface 1804, and/or memory 1806. In some embodiments, the power divider 1807 may be part of an electronic circuit package 503 of FIG. 5A.

The above discussed antenna structures for millimeter band radio frequency communication with dual radiating elements may produce uniform radiation patterns with respect to the front face and back face of a mobile device. The dual patch antennas and/or the dual DRA antenna may control the radiation pattern of the antenna. A collection of the dual radiating elements arranged in an array may provide MIMO communication in addition to omni-directional radiation patterns. In some embodiments, the polarization of the first radiating element of the dual radiating element antenna may be orthogonal to the second radiating element, improving far field gain. In some embodiments, a power divider may be used in conjunction with dual radiating element antenna to improve coverage of the antenna. In some embodiments, a metal ring antenna may be used in conjunction with the dual radiating element antenna for cellular frequency communication. The described inventive concepts create antenna structures with omni-directional radiation, wide bandwidth, and/or multi-frequency use.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," "including,", "having," and/or variants thereof, when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

first and second conductive layers arranged in a face-to-face relationship, separated from one another by a first dielectric layer;

a first radiating element; and a second radiating element that at least partially overlaps the first radiating element, wherein the second conductive layer comprises a stripline, wherein the wireless electronic device is configured to resonate at a resonant frequency corresponding to the first radiating element and/or the second radiating element when excited by a signal transmitted or received though the stripline, and wherein the first radiating element and the second radiating element are configured such that a first polarization of the signal at the first radiating element is orthogonal to a second polarization of the signal at the second radiating element.

2. The wireless electronic device of claim 1, wherein the stripline overlaps the first radiating element and/or the second radiating element.

3. The wireless electronic device of claim 1, further comprising:

a power divider that is electrically coupled to the stripline and is configured to control a power of the signal that is applied to the first radiating element and/or the second radiating element.

4. The wireless electronic device of claim 3, wherein the power divider is configured to provide a first portion of the power of the signal to the first radiating element for a first time period, and a second portion of the power of the signal to the second radiating element for a second time period.

5. The wireless electronic device of claim 4, wherein the stripline comprises a first stripline associated with the first radiating element, the wireless electronic device further comprising:

a second stripline associated with the second radiating element, wherein the second stripline is in a third conductive layer that is arranged in a face-to-face relationship with the first conductive layer and/or the second conductive layer, wherein the power divider is configured to provide the first portion of the power of the signal to the first stripline and is configured to provide the second portion of the power of the signal to the second stripline.

6. The wireless electronic device of claim 3, wherein the power divider is configured to provide all of the power of the signal to the first radiating element for a first time period, and provide all of the power of the signal to the second radiating element for a second time period, and wherein the first time period does not overlap the second time period.

7. A wireless electronic device, comprising:

first and second conductive layers arranged in a face-to-face relationship, separated from one another by a first dielectric layer;

a first radiating element; and a second radiating element;

one or more third radiating elements; and one or more fourth radiating elements, wherein the second conductive layer comprises a stripline, wherein the second radiating element at least partially overlaps the first radiating element, wherein the wireless electronic device is configured to resonate at a resonant frequency corresponding to the first radiating element and/or the second radiating element when excited by a signal transmitted or received though the stripline, wherein the stripline comprises a first stripline, wherein the second conductive layer comprises one or more additional striplines, wherein respective ones of the one or more third radiating elements at least partially overlap the respective ones of the one or more fourth radiating elements, and wherein a respective one of the one or more third radiating elements and an associated one of the one or more fourth radiating elements are configured such that a polarization of the signal at the respective one of the one or more third radiating elements is orthogonal to a polarization of the signal at the associated respective one of the one or more fourth radiating elements.

8. The wireless electronic device of claim 7, wherein the first stripline and the one or more additional striplines are arranged in an array and are configured to receive and/or transmit multiple-input and multiple-output (MIMO) communication.

9. The wireless electronic device of claim 7, further comprising:

a fourth conductive layer comprising the first radiating element; and a fifth conductive layer comprising the second radiating element, wherein the first radiating element comprises a first patch element, and wherein the second radiating element comprises a second patch element, wherein first and fourth conductive layers are arranged in a face-to-face relationship, separated from one another by a second dielectric layer, and wherein the second and fifth conductive layers are arranged in a face-to-face relationship, separated from one another by a third dielectric layer that is opposite the first dielectric layer.

10. The wireless electronic device of claim 9 further comprising:

a third conductive layer comprising a second stripline; and a sixth conductive layer, wherein the third conductive layer and the sixth conductive layer are separated from one another by a fourth dielectric layer, that is opposite the third dielectric layer, and wherein the sixth conductive layer and the fifth conductive layer are separated from one another by a sixth dielectric layer that is opposite the fourth dielectric layer.

11. The wireless electronic device of claim 10, further comprising:

a seventh conductive layer comprising a ground plane, wherein the seventh conductive layer is between the third dielectric layer and a fifth dielectric layer that is adjacent the third conductive layer.

12. The wireless electronic device of claim 9 further comprising:

one or more third patch elements in the fourth conductive layer; and one or more fourth patch elements in the fifth conductive layer, wherein the second conductive layer comprises one or more additional striplines, and wherein respective ones of the one or more third patch elements at least partially overlap the respective ones of the one or more fourth patch elements.

13. The wireless electronic device of claim 7, wherein the first radiating element comprises a first dielectric block on the first conductive layer, and wherein the second radiating element comprises a second dielectric block on a sixth conductive layer.

14. The wireless electronic device of claim 13 further comprising:

a third conductive layer comprising a second stripline, wherein the second conductive layer and the third conductive layer are separated from one another by a third dielectric layer, and wherein the third conductive layer and the sixth conductive layer are separated from one another by a fourth dielectric layer, that is opposite the third dielectric layer.

15. The wireless electronic device of claim 14, further comprising a seventh conductive layer comprising a ground plane, wherein the seventh conductive layer is between the third dielectric layer and a fifth dielectric layer that is adjacent the third conductive layer.

16. The wireless electronic device of claim 7, wherein the resonant frequency comprises a first resonant frequency, the wireless electronic device further comprising:

a metal ring antenna configured to resonate at a second resonant frequency that is different from the first resonant frequency, wherein the metal ring antenna is spaced apart and electrically isolated from the first conductive layer and/or the second conductive layer.

17. The wireless electronic device of claim 16, wherein the metal ring antenna extends along an outer edge of the wireless electronic device.

18. A wireless electronic device, comprising:

a printed circuit board (PCB) comprising:

a first radiating element on a first conductive layer comprising a first slot, wherein the first slot is at least partially overlapped by the first radiating element;

a second radiating element on a sixth conductive layer comprising a second slot, wherein the second slot is at least partially overlapped by the second radiating element;

a second conductive layer comprising a first stripline;

a third conductive layer comprising a second stripline;

a seventh conductive layer comprising a ground plane;

a first dielectric layer between the first conductive layer and the second conductive layer;

a third dielectric layer between the second conductive layer and the seventh conductive layer, opposite the first dielectric layer;

a fifth dielectric layer between the seventh conductive layer and the third conductive layer, opposite the third dielectric layer; and a fourth dielectric layer between the third conductive layer and the sixth conductive layer, opposite the fifth dielectric layer, wherein the first radiating element and the second radiating element are configured such that a first polarization of a signal at the first radiating element is orthogonal to a second polarization of the signal at the second radiating element.

19. The wireless electronic device of claim 18, further comprising:

a metal ring antenna that extends along an outer edge of the PCB.

* * * * *